US005652649A

United States Patent [19]

Ikegawa et al.

[11] Patent Number: 5,652,649

[45] Date of Patent: Jul. 29, 1997

[54] CHARGING DEVICE AND IMAGE FORMING APPARATUS

[75] Inventors: Akihito Ikegawa, Sakai; Keiko Nagayasu, Ibaraki; Isao Doi, Toyonaka, all of Japan

[73] Assignees: Minolta Co., Ltd; Toeisangyo Co., Ltd., both of Japan

[21] Appl. No.: 554,530

[22] Filed: Nov. 7, 1995

[30] Foreign Application Priority Data

| | | | |
|---|---|---|---|
| Nov. 8, 1994 | [JP] | Japan | 6-273710 |
| Nov. 8, 1994 | [JP] | Japan | 6-273723 |
| Nov. 9, 1994 | [JP] | Japan | 6-274841 |

[51] Int. Cl.[6] ..... G03G 15/02; G03G 15/24

[52] U.S. Cl. ..... 399/175; 361/221; 399/150

[58] Field of Search ..... 355/219, 269; 361/221, 222, 225, 214

[56] References Cited

U.S. PATENT DOCUMENTS

| | | | |
|---|---|---|---|
| 4,706,320 | 11/1987 | Swift | 15/1.51 |
| 5,148,219 | 9/1992 | Kohyama | 355/219 |
| 5,196,892 | 3/1993 | Mitsuaki | 355/269 |
| 5,221,946 | 6/1993 | Kohyama | 355/270 |
| 5,245,386 | 9/1993 | Asano et al. | 335/219 |
| 5,398,102 | 3/1995 | Wada et al. | 355/219 |
| 5,426,488 | 6/1995 | Hayakawa et al. | 355/219 |
| 5,455,661 | 10/1995 | Yoshida et al. | 355/219 |

FOREIGN PATENT DOCUMENTS

| | | |
|---|---|---|
| 59-33467 | 2/1984 | Japan . |
| 61-107357 | 5/1986 | Japan . |

*Primary Examiner*—Arthur T. Grimley
*Assistant Examiner*—Sophia S. Chen
*Attorney, Agent, or Firm*—Sidley & Austin

[57] ABSTRACT

In electrophotographic image forming, there are provided a charging device and an image forming apparatus provided with the charging device for forming an image including no or less image noise by sufficiently suppressing generation of image memory due to untransferred residual developer. The charging device has, for example, a charging brush formed of a roller and a strip-like fiber member having a plurality of piles wound therearound. The brush satisfies a condition of $0.7s<d<1.5s$ where d(mm) is a wound margin of the strip-like fiber member, and s(mm) is an average distance between the piles in a width direction of the fiber strip member.

17 Claims, 16 Drawing Sheets

Lmin/Lmax=1.0

Lmin/Lmax=0.6

Lmin/Lmax=0.44

Lmin/Lmax=0.4

Lmin/Lmax=0.2

CHARGING DEVICE AND IMAGE FORMING APPARATUS

BACKGROUND OF THE INVENTION

1. Field of the Invention

The present invention relates to a charging device employed in an electrophotographic image forming apparatus such as a copying machine and a printer as well as an image forming apparatus provided with the charging device.

2. Description of the Related Art

In a conventional electrophotographic image forming apparatus such as a copying machine and a printer, a toner image formed on a photosensitive member, which is generally used as an electrostatic latent image carrier, is transferred onto a transfer member, and the transferred toner image is fixed on the transfer member. More specifically, a charging device uniformly charges the photosensitive member. The electrostatic latent image is formed on the charged photosensitive member by an image exposing device. A developing device develops the electrostatic latent image on the photosensitive member to form a toner image. A transfer device transfers the toner image onto the transfer member. After this transfer, toner remaining on the photosensitive member is removed from the photosensitive member by a cleaning device.

In recent years, there has been proposed a so-called cleanerless image forming apparatus from which a cleaning device is eliminated in order to comply with demand for reduction of size and cost of the image forming apparatus. For example, U.S. Pat. Nos. 5,148,219 and 5,221,946 have disclosed cleanerless image forming apparatuses, in which a developing device additionally has a cleaning function for removing residual toner and can perform cleaning simultaneously with developing. The developing devices disclosed in these patents utilize a potential difference between a developing sleeve and the photosensitive member for adhering the toner onto an exposed portion of the photosensitive member and removing residual toner adhering to an unexposed portion of the photosensitive member.

In such cleanerless image forming apparatuses, a slight amount of toner inevitably remains on the photosensitive member after the transfer, so that exposure is effected on the photosensitive member through the residual toner which has remained since preceding cycles, when the image forming cycle is repeated. Therefore, unremoved residual toner intercepts light beams at a certain portion, so that the light-intercepted portion will produce an image memory on an image formed in the next operation.

The cleanerless image forming apparatuses disclosed in the above patents employ a rotary brush charger as the charging device, so that the residual toner on the photosensitive member may be scattered by a brush into an unpatterned form.

In practice, however, only the employment of the rotary brush charger cannot sufficiently suppress generation of an image memory.

SUMMARY OF THE INVENTION

Accordingly, it is an object of the invention to provide a charging device used in an electrophotographic image forming apparatus, wherein untransferred developer remaining on an electrostatic latent image carrier after transfer of a visible toner image onto a transfer member can be uniformly scattered into an unpatterned form without irregularity, so that generation of an image memory can be sufficiently suppressed.

Another object of the invention is to provide an electrophotographic image forming apparatus, in which generation of an image memory due to untransferred residual developer can be sufficiently suppressed, and thereby an image of a good quality can be formed while suppressing image noises.

Still another object of the invention is to provide an electrophotographic image forming apparatus of a cleanerless type, in which generation of an image memory due to untransferred residual developer can be sufficiently suppressed, and thereby an image of a good quality can be formed while suppressing image noises, and in which residual toner can be cleaned up simultaneously with developing.

In order to achieve the above objects, the present invention provides the following charging devices and image forming apparatuses.

(1) A charging device for electrically charging a surface of a member to be charged, comprising:

a roller which is rotatably provided; and a strip-like fiber member which is spirally wound around said roller, said strip-like fiber member having a plurality of piles, said piles being in contact with said surface of said member to be charged, wherein said charging device satisfies the following formula:

$$0.7s<d<1.5s$$

where d(mm) is a wound margin of said strip-like fiber member, and s(mm) is an average distance between said piles in a width direction of said strip-like fiber member.

In the above charging device, it is preferable that the surface of the member to be charged and the piles move in the same direction at a contact area where the piles are in contact with the surface, and a velocity of the piles is one through four times as large as a velocity of the surface at the contact area.

Each of the piles may have a plurality of fibers.

The above charging device of the above type can sufficiently suppress generation of image noises, which may be caused particularly by the wound margin of the fiber strip member around the roller.

(2) A charging device for electrically charging a surface of a member to be charged, comprising:

a fiber member having a plurality of piles, said piles being in contact with said surface of said member to be charged, wherein said charging device satisfies the following formula:

$$0.44 \leqq Lmin/Lmax \leqq 1$$

where Lmax and Lmin are the maximum value and minimum value of distances from one of the piles to the other piles adjacent thereto, respectively.

In the above charging device, it is preferable to satisfy further the following formula:

$$0.6 \leqq Lmin/Lmax \leqq 1$$

Each of the piles may have a plurality of fibers.

The charging device of the above type can sufficiently suppress grouping of the brush fibers, which may be caused particularly by adhesion of toner onto the brush fibers of the charging brush, and thereby the member to be charged can be charged more uniformly while sufficiently suppressing generation of an image memory.

(3) A charging device for electrically charging a surface of a member to be charged, comprising:

a rotatable roller; and a fiber sheet provided on said roller, said fiber sheet having a plurality of piles each having a plurality of brush fibers, wherein said charging device satisfies the following formula:

$$1000<N\cdot D<10000$$

where D (μm) is a diameter of each of the brush fibers, and N is a number of the brush fibers of each of said piles.

In this charging device, the value D is preferably in a range from 5 [μm] to 100 [μm].

In this charging device, the value N is preferably in a range from 60 to 600.

The charging device of the above type can sufficiently suppress reduction of a durability of the member to be charged, which may be caused by shaving or the like of the member, and can also effectively and uniformly scatter the untransferred residual developer to charge the member to be charged uniformly.

In each of the charging devices (1)–(3), the member to be charged is typically an electrostatic latent image carrier, and more typically is a photosensitive member.

(4) An image forming apparatus for forming an image, comprising:

a member on which an image is formed, said member moving in a moving direction;

a rotatable roller;

a fiber sheet provided on said roller, and having a plurality of brush fibers on a base, said brush fibers being in contact with a surface of said member at a contact area, wherein m defined by the following equation is in a range from 350 to 4000, $$m=(c/b)\cdot w\cdot|\theta-1|\cdot M$$

where b (mm) is a diameter of the roller with the fiber sheet, c (mm) is a diameter of the roller with the base of the fiber sheet, w (mm) is a width of nip between said brush fibers and said member, θ is a quotient which is made by division of a velocity of the brush fibers at the contact area by a velocity of said member at the contact area, and M (1/1 $mm^2$) is an average density of the brush fibers.

In other words, M is the average number of the brush fibers per area (1 $mm^2$) of the base of the fiber sheet.

The fiber sheet may have a plurality of piles each of which has a plurality of said brush fibers.

The charging device of the above type can sufficiently suppress reduction of a durability of the member, on which the image is formed, by preventing shaving of the member, and can also suppress variation of the charged potential of the member due to environmental variation. Further, the apparatus can sufficiently suppress generation of an image memory by sufficiently scattering the untransferred residual developer, and thereby can form an image of a good quality with less image noise.

The "member on which an image is formed" is typically an electrostatic latent image carrier, and more typically is a photosensitive member.

The values b(mm), c(mm), θ and M may be as follows:

b is in a range from 10 to 30 c is in a range from 4 to 13

θ is in a range from 0.5 to 10

M is in a range from 23 to 310.

(5) An image forming apparatus provided with one of the charging devices of above (1), (2) and (3).

(6) An image forming apparatus described in one of the above (4) and (5), and being of a cleanerless type for simultaneously performing developing and cleaning of untransferred residual developer.

The foregoing and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Embodiments of the invention will be described below with reference to the drawings.

(First Embodiment)

First, description will be given on a printer P1 provided with a charging device of the invention with reference to FIGS. 1 through 6.

Figure 1:
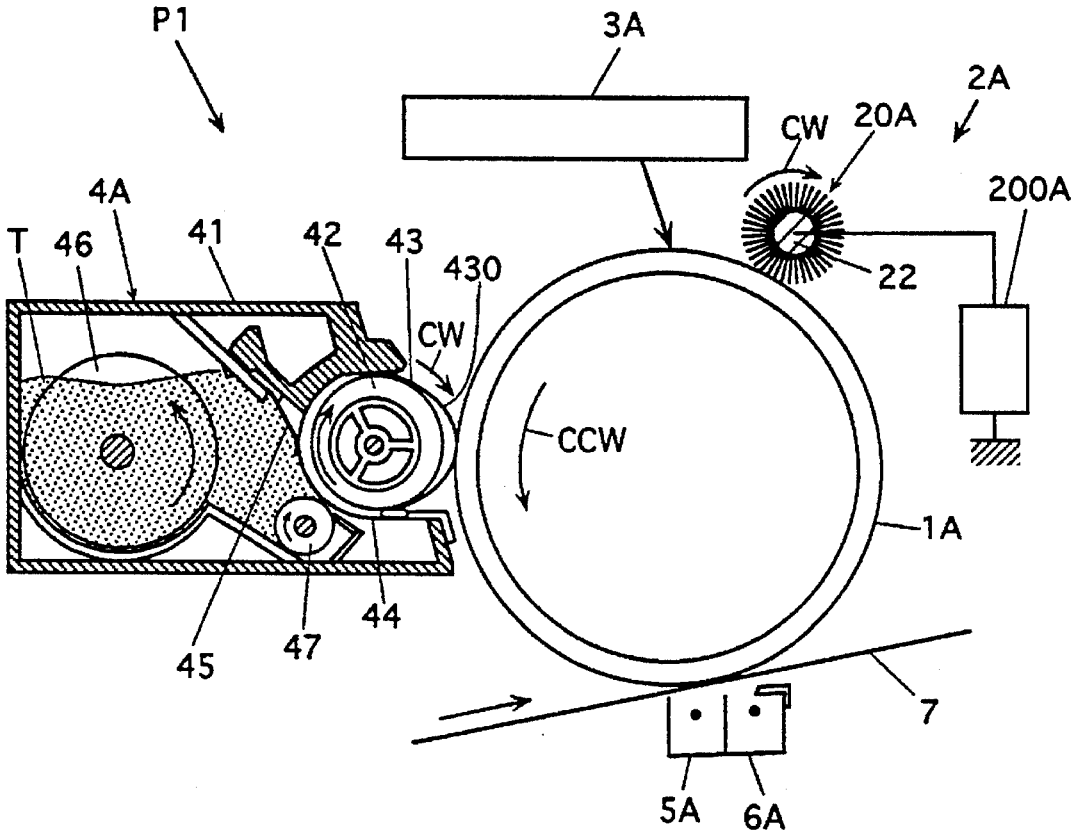
FIG. 1 schematically shows a structure of an example of a printer according to the invention.

FIG. 1 shows a schematic structure of the printer P1. The printer P1 is provided at its central portion with a photosensitive drum 1A, i.e., electrostatic latent image carrier. The drum 1A is driven to rotate in a direction indicated by an arrow CCW in the figure (i.e., counterclockwise direction) by an unillustrated driving device. Around the drum 1A, there are sequentially disposed a brush charging device 2A, an exposing device 3A, a developing device 4A, a transfer charger 5A, and a separating charger 6A.

The brush charging device 2A is a contact charging device provided with a roller-like rotary brush 20A formed of electrically conductive fibers. The rotary brush 20A is in contact with the photosensitive drum 1A and is driven to rotate in a clockwise direction CW in the figure. A power source 200A applies a DC voltage of −1.3 kV to charge a surface of the photosensitive drum 1A to −800 V. The charging device 2A will be described later more in detail.

The exposing device 3A is of a known type using a semiconductor laser, and is adjusted to lower the potential of an image portion of the surface of the photosensitive drum 1A charged to −800 V to about −50 V with laser beam irradiation.

The developing device 4A is a mono-component developing device, and has such a structure that a drive roller 42 to be driven to rotate clockwise (in the direction of arrow CW) is supported by a casing 41, a flexible developing sleeve 43 having an inner diameter slightly larger than the outer diameter of the roller 42 is fitted around the roller 42, opposite ends of the sleeve 43 are pressed against the drive roller 42 by a pressing belt member 44 inside the casing 41 to form a slack portion 430 at the opposite side, and the slack portion is in contact with the photosensitive drum 1A. The developing sleeve 43 is in contact with a restriction blade 45 made of metal and located inside the casing 41.

Toner T, which is mono-component developer contained in the casing 41 is stirred by a stirring member 46 rotated counterclockwise in the figure and is supplied onto a toner transporting roller 47. The roller 47 is driven to rotate clockwise in the figure for moving the toner T toward the developing sleeve 43. In accordance with rotation of the drive roller 42, the developing sleeve 43 is frictionally driven in the same direction by the drive roller 42, while the restriction blade 45 frictionally charges the toner T and adheres the toner T at a constant rate onto the developing sleeve 43. In accordance with the rotation, the developing sleeve 43 successively supplies the toner T to a contact portion at which the sleeve 43 is in contact with the photosensitive drum 1.

A power source (not shown) applies to the developing sleeve 43 a developing bias voltage of −250 V, by which the toner T can be adhered onto an electrostatic latent image on the photosensitive drum 1A.

The photosensitive drum 1A, the toner T and the developing sleeve 43 are specifically formed or constructed as follows.

Photosensitive Drum 1A

On an aluminum substrate (drum), there are formed a charge generating layer (CGL) of about 0.1 μm in thickness formed of phthalocyanine and binder resin as well as a charge transporting layer (CTL) of about 18 μm in thickness formed of hydrazone dielectric material and binder resin and arranged thereon. Each layer is formed by repeating dipping, coating and subsequent drying.

Toner T

The toner T, which is negatively chargeable mono-component nonmagnetic toner, has the following composition and manufactured by the following process.

Bisphenol A polyester resin at 100 weight parts

Carbon black (MA#8 manufactured by Mitsubishi Kasei Kogyo Kabushiki Kaisha) at 5 weight parts Charge control agent (Bontron S-34 manufactured by Orient Kagaku Kogyo Kabushiki Kaisha) at 3 weight parts Wax (Viscorl TS-200 manufactured by Sanyo Kasei Kogyo Kabushiki Kaisha) at 2.5 weight parts.

These materials are kneaded, ground and classified to manufacture toner particles having a mean diameter of 10 μm and a distribution, in which 80 weight percents are included in a range of the particle diameters from 7 μm to 13 μm. Minute silica particles (Tanolux 500 manufactured by Gyabojil Co.) at 0.75 weight percents is added to the toner particles for surface treatment.

Developing Sleeve 43

A round rod of 25 mm in diameter made of stainless steel is dipped into nickel electrolyte, and a film of about 35 μm in thickness is formed by electroforming. A nip width of from about 1 to about 1.5 mm is achieved between the sleeve 43 and the photosensitive drum 1A in the developing operation.

The restriction blade 45 can adhere the toner T onto the developing sleeve 43 with an adhesion rate of 0.6 mg/cm$^2$, a toner layer thickness of about 0.03 mm and a charging quantity of −20 μC/g.

The charging device 2A will be further described below.

Among contact charging devices employed in the electrophotographic image forming apparatus, the charging device of the brush type such as the charging device 2A is advantageous in the image forming apparatus of the cleanerless structure in view of the fact that, untransferred developer remaining on the electrostatic latent image carrier is scattered by the brush for suppressing generation of a so-called memory due to the residual developer.

Among charging devices of the brush type, the charging device provided with a rotary brush such as a charging device 2A is preferable in view of stability in the charging.

Such charging rotary brushes are manufactured selectively by various methods, and typically may be manufactured and constructed in such a manner, in order to achieve intended strength, productivity, fiber density and others, that many bundles or piles each formed of many electrically conductive brush fibers are fixed at spaced positions in a base member such as a base cloth to form a strip-like brush member, and this brush member is spirally wound around a core roller.

Figure 2:
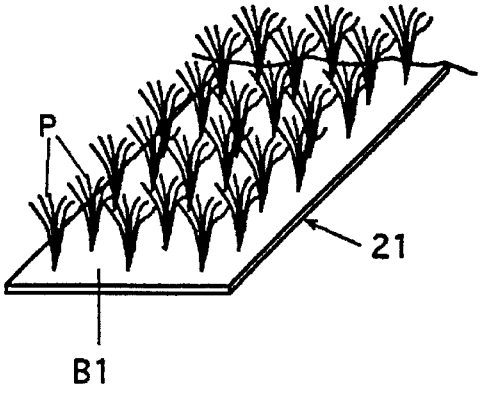
FIG. 2 schematically shows an example of a structure of a strip-like brush member in a brush charging device.

The strip-like brush member may selectively have various structures, and typically may have a structure which is substantially the same as a so-called velvet in view of strength, productivity, fiber density and others. Namely, as schematically shown in FIG. 2, many piles P made of electrically conductive brush fibers are woven at positions in a base member or base cloth B1, which are spaced from each other by an inter-pile distance (which may be referred to as "inter-pile distance s" or simply as "s") to form a member 21 of a strip-like form or another form to be cut into a strip-like form.

Another structure may be employed. For example, the member may be formed in such a manner that many bundles or piles each formed of electrically conductive brush fibers are fixed at spaced positions in a flexible base member or sheet of synthetic resin to form a member of a strip-like form or another form which will be cut into a strip-like form.

Figure 3:
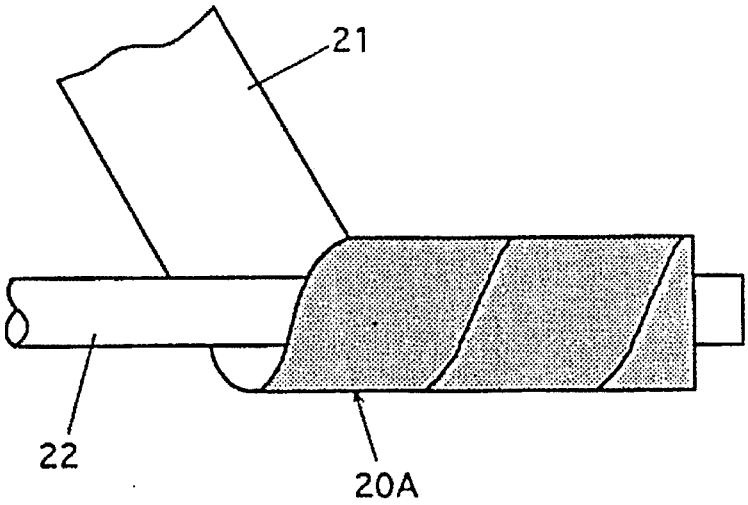
FIG. 3 shows an example of a method of forming a rotary brush from a strip-like brush member shown in FIG. 2.

The rotary brush 20A of the charging device 2A in the printer in FIG. 1 may be provided in various manners, and typically, the strip-like brush member 21 is spirally wound with a predetermined wound margin d around an electrically conductive core roller 22 having a circular section and formed of a conductive metal member, a conductive synthetic resin member or an insulating member treated to have an electrically conductive surface as shown in FIG. 3. In this case, electrically conductive adhesive is used to fix the brush member onto the roller 22.

Figure 4:
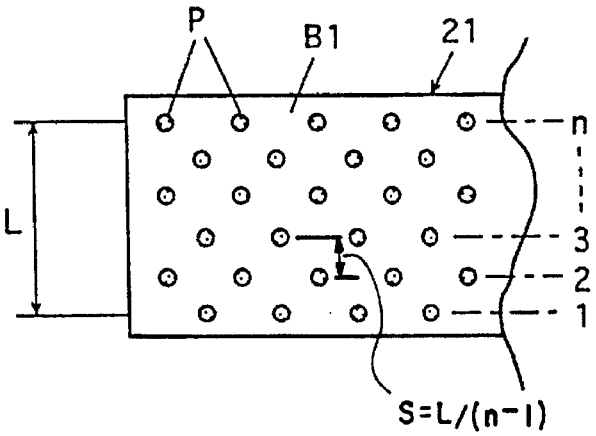
FIG. 4 shows a method of determining an inter-pile distance of a strip-like brush member.

The "wound margin d" and "inter-pile distance s" will be described below in connection with the brush member 21 in FIG. 2. In the structure shown in FIG. 5, the wound margin d is a space or distance between the piles P at edge portions of the strip-like brush member 21 on the roller 22 which are adjacent to each other with an edge boundary therebetween. As shown in FIG. 4, the "inter-pile distance s" is a quotient which is made by division of a distance L between the piles P at the opposite sides of the brush member by {(the number of rows of piles P)−1}, and thus can be expressed as $s=L/(n-1)$ In this rotary brush 20A, the core roller 22 has a diameter of 8 mm and a brush pile length of 5 mm, and is pressed at its tips of about 1 mm in length against the surface of the photosensitive drum 1A. With respect to the photosensitive drum 1A Of a peripheral velocity of 3.5 cm/sec, the rotary brush 20A is rotated at a peripheral velocity, which is one through four times as large as that of the photosensitive drum, so that contacted portions of them move in the same direction. The wound margin d is determined with respect to the inter-pile distance s to satisfy the following relationship:

$$0.7s<d<1.5s$$

According to the printer described above, the surface of the photosensitive drum 1A which is driven to rotate is charged uniformly to −800 V by the brush charging device 2A.

Figure 5:
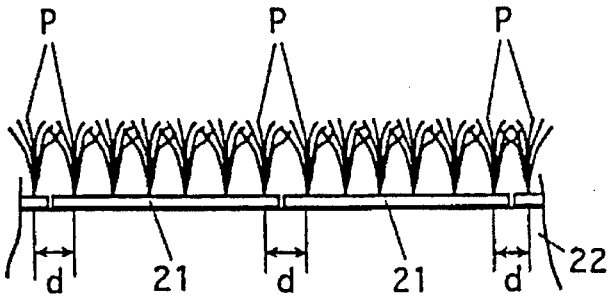
FIG. 5 is an schematic and fragmentary enlarged cross section of the strip-like brush member on the rotary brush.

As shown in FIG. 5, although the fibers of one pile are bundled at the root of the pile P, the fibers are dispersed at the edge of the pile P. Therefore, the fibers of one pile P are in contact with or closed to the fibers of the adjacent piles P at the edge. The dispersion of the fibers of the pile P causes the uniform density of the fibers of the piles P at the edges thereof. The uniform density of the fibers is good for charging the photosensitive drum 1A uniformly.

The exposing device 3A effects the image exposure on the charged region to form the electrostatic latent image. The potential of the exposed surface portion is lowered to about −50 V. The electrostatic latent image thus formed is developed by the developing device 4A with a developing bias voltage of −250 V into a toner image. In this developing, the toner T on the developing sleeve 43 adheres onto the electrostatic latent image with a potential difference ΔV of 200 V.

The transfer charger 5A transfers the toner image thus formed onto a sheet of paper 7 supplied from a transfer sheet supply device (not shown). After the transfer, the sheet 7 is separated from the photosensitive drum 1A by the separating charger 6A, moves to a fixing device (not shown) to fix the toner image, and then is discharged.

However, the toner on the photosensitive drum 1A is not entirely transferred onto the sheet 7 by the transfer charger 5A, but 10–20% of the toner generally remains as the residual toner on the photosensitive drum 1A. The residual toner returns to the developing device 4 through the charging stage performed by the charging device 2A and, if necessary, the stage for image exposure by the exposing device 3, and the residual toner on the non-image portion is collected into the developing sleeve 43.

The collection of toner will be described more in detail below. Even at a portion covered with the residual toner, the surface potential of the photosensitive drum 1A is charged substantially uniformly to about −800 V. Meanwhile, the developing bias voltage of −250 V is applied to the developing sleeve 43. Therefore, the residual toner T on the non-image portion of the photosensitive drum 1A is forced to move toward the developing sleeve 43 by a potential difference of about 550 V, and simultaneously the developing sleeve 43 applies a scraping effect on the residual toner, so that the residual toner at the non-image portion is removed and collected toward the developing sleeve 43.

Prior to the above, the residual toner remaining on the photosensitive drum 1A is stirred and scattered by the rotary brush 20A in the charging device 2A, so that it will not remain as an after-image on the photosensitive drum 1A.

The wound margin d of the strip-like brush member 21 in the rotary brush 20A and the inter-pile distance s is determined to satisfy the following relationship:

$$0.7s<d<1.5s$$

Therefore, an image noise corresponding to the wound margin of the strip-like brush member 21 does not occur, and generation thereof is sufficiently suppressed, resulting in improvement of the image quality.

Experiments (experimental examples a1–a8) of image formation were performed as follows. A mesh image sample of one-on/one-off at a density of 300 dpi was used. A relationship between the wound margin d and the inter-pile distance s was varied within a range of $0.7s<d<1.5s$. Formed images were visually evaluated. Also, Experiments (examples for comparison a1–a6) were also performed under such a condition that the wound margin d was set in a range other than said range, and the images formed in a similar manner were visually evaluated. The velocity ratio of the rotary brush 20A with respect to the photosensitive drum 1A was selected from the range of 1–4.

In the result of evaluation of the image noises, circular mark "0" represents that no winding or spiral noise was found, a triangular mark "Δ" represents that slightly visible but acceptable winding noises were found, and a cross mark "X" represents that winding noises at the unacceptable level was clearly found.

| | Velocity Ratio | s (mm) | d (mm) | d/s | Noise Evaluation |
|---|---|---|---|---|---|
| Experimental Example | | | | | |
| a1 | 2 | 0.7 | 0.6 | 0.86 | ○ |
| a2 | 2 | 0.7 | 0.8 | 1.14 | ○ |
| a3 | 2 | 0.7 | 1 | 1.43 | Δ |
| a4 | 3 | 1 | 0.8 | 0.8 | ○ |
| a5 | 3 | 1 | 1.2 | 1.2 | ○ |
| a6 | 3 | 1 | 1.4 | 1.4 | Δ |
| a7 | 4 | 1.2 | 1 | 0.83 | Δ |
| a8 | 4 | 1.2 | 1.5 | 1.25 | ○ |
| Example for Comparison | | | | | |
| a1 | 2 | 0.7 | 1.5 | 2.14 | X |
| a2 | 2 | 1 | 2 | 2 | X |
| a3 | 3 | 1.2 | 0.6 | 0.5 | X |
| a4 | 3 | 1.2 | 2 | 0.67 | X |
| a5 | 4 | 1 | 0.6 | 0.6 | X |
| a6 | 4 | 1 | 1.7 | 1.7 | X |

Figure 6:
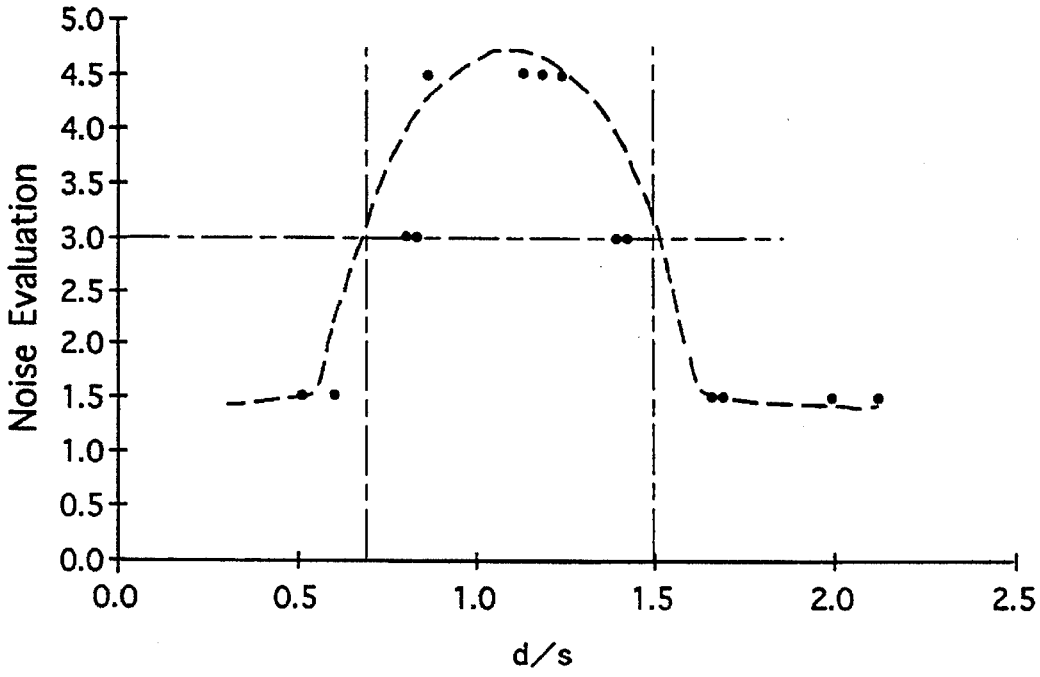
FIG. 6 is a graph in which values of an image noise level is plotted with respect to a ratio of a wound margin d to an inter-pile distance s.

The image noise levels with respect to d/s are plotted in FIG. 6, in which the image noise evaluation ranks "O", "Δ" and "X" in the above list are numerically expressed as 4.5, 3 and 1.5, respectively. From the above results, the levels at which no noise was found or noises were acceptable are found in the images which were formed with the rotary brush satisfying the relationship of $0.7s<d<1.5s$ between the wound margin d and inter-pile distance s.

According to the printer described above, the wound margin of the strip-like brush member 21 around the roller 22 in the rotary brush 20A of the charging device 2A can completely or sufficiently suppress an image noise, resulting in improvement of the image quality.

(Second and Third Embodiments)

Second and third embodiments will be described below. Image forming apparatus to be described below relates to a simultaneous developing/cleaning type, in which a charging device for charging an electrostatic latent image carrier is formed of a contact brush charging device. In this brush charging device, bundles of brush fibers are fixed at many positions of the base member, and the following relationship is satisfied, where the minimum and maximum distances between adjacent two bundles are expressed as Lmin and Lmax, respectively.

$$0.44 \leqq Lmin/Lmax \leqq 1$$

The image forming apparatus of the above type particularly suppresses grouping of the brush fibers of the charging brush, and thus can charge more uniformly the electrostatic latent image carrier.

Respective components of the image forming apparatus of the above type will now be described below.

(1) With respect to the structure and material of the brush member

The brush member forming the above contact brush charging device may selectively employ various structures, and typically may have a structure which is substantially the same as a so-called velvet in view of strength, productivity, fiber density and others. For example, as schematically indicated at BM1 in FIG. 9(A), the piles P formed of brush fibers are woven into many spaced positions of the base member, i.e., base cloth B1. Alternatively, as indicated at BM2 in FIG. 9(B), the piles P formed of brush fibers are woven into many spaced positions of the base member B2 made of a flexible synthetic resin sheet. These brush members provided with the piles at regular pitches can be employed in the invention.

In any of the structures, each pile may be typically formed of a bundle including 20 to 200 brush fibers each having a diameter of about 10 μm.

Figure 9:
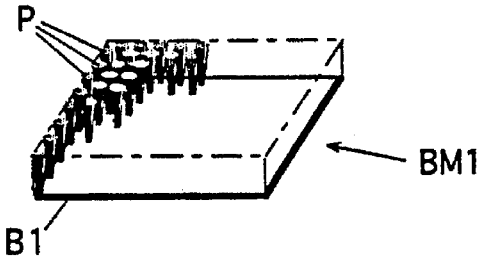
FIGS. 9(A) and 9(B) show examples of a structure of a brush member employed in a charging device, and more specifically, show a structure including piles woven into a base cloth and a structure including piles woven into a synthetic resin base member, respectively.
Figure 9:
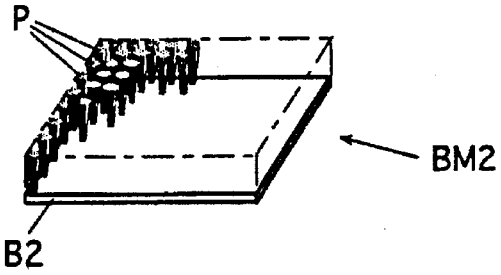
Figure 10:
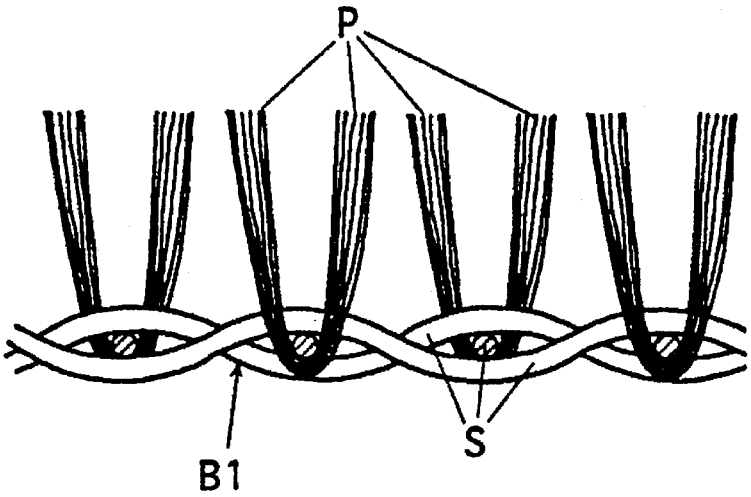
FIGS. 10(A) and 10(B) show an example of the brush member shown in FIG. 9(A) including piles woven into the base cloth in a V-shaped form, and more specifically, are a schematic cross section and a schematic plan of the brush member, respectively.
Figure 10:
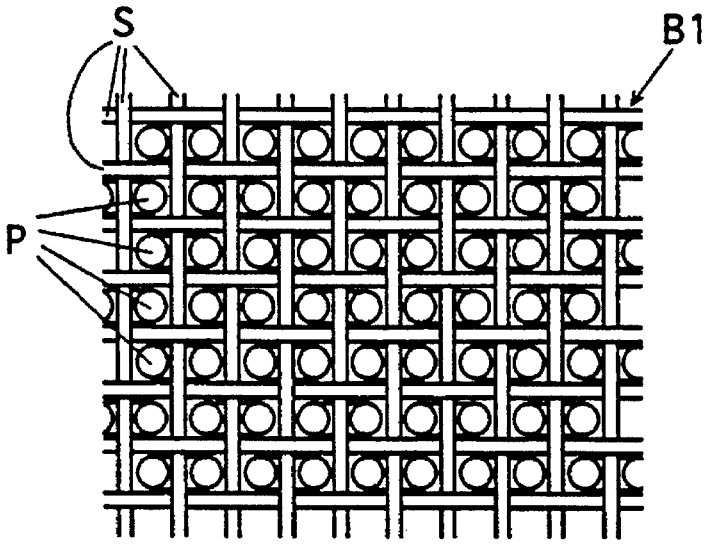

In the case where the brush member BM1 of the type shown in FIG. 9(A) is employed, the manner of weaving of the piles P into the base cloth B1 may be typically a so-called V-shaped weaving shown in FIGS. 10(A) and 10(B) in which each pile P is woven into yarns S forming the base cloth B1 in a V-shaped form. Alternatively, it may be a so-called W-shaped weaving shown in FIGS. 11(A) and 11(B), in which each pile P is woven into yarns S forming the base cloth B1 in a W-shaped form. The W-shaped weaving can prevent disengage or drop of brush fibers more effectively than the V-shaped weaving.

Figure 12:
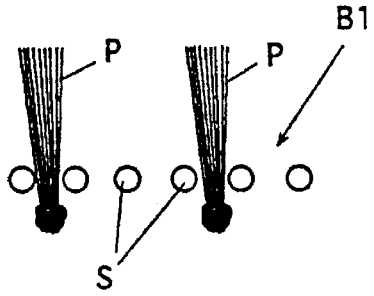
FIGS. 12(A) through 12(F) show another examples of a manner of weaving piles into a base cloth of a brush member, respectively.
Figure 12:
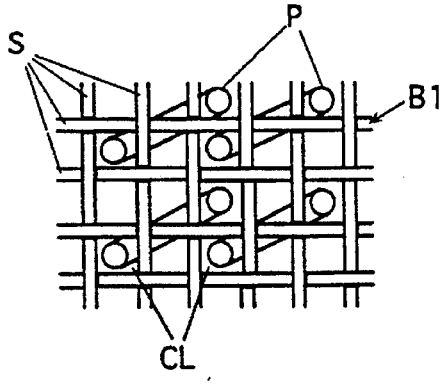
Figure 12:
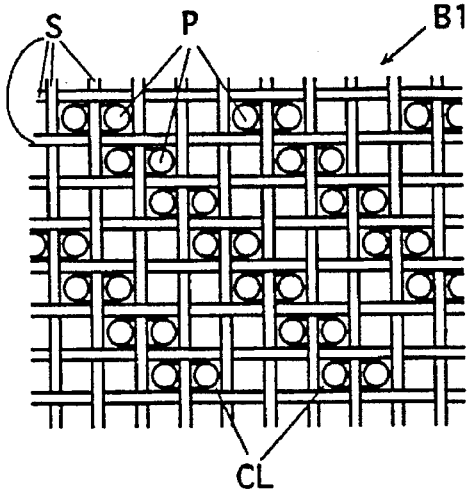
Figure 12:
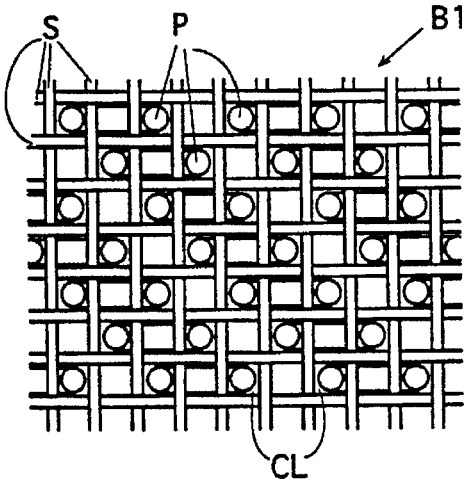
Figure 12:
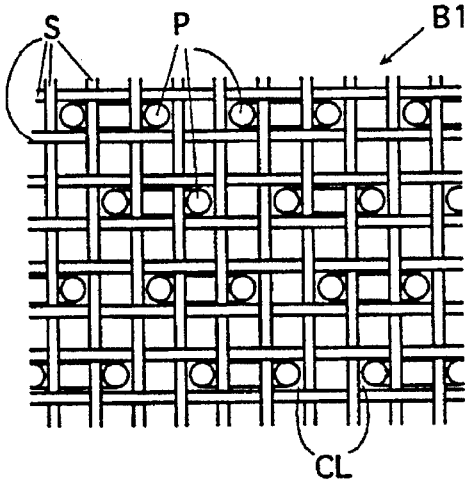
Figure 12:
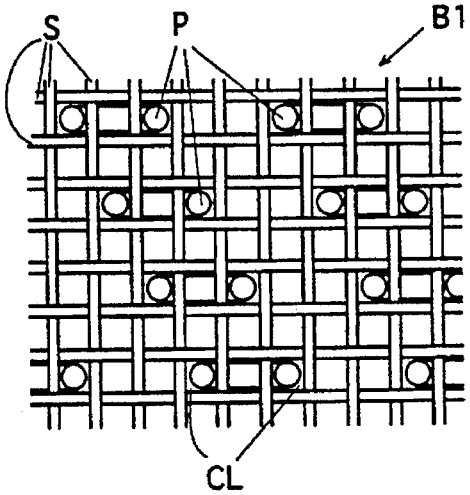

As a special weaving manner, the manner shown in FIG. 12(A) may be employed in which each pile P is passed through the base cloth B1, and a flat knot is formed at the rear side of the base cloth.

Figure 11:
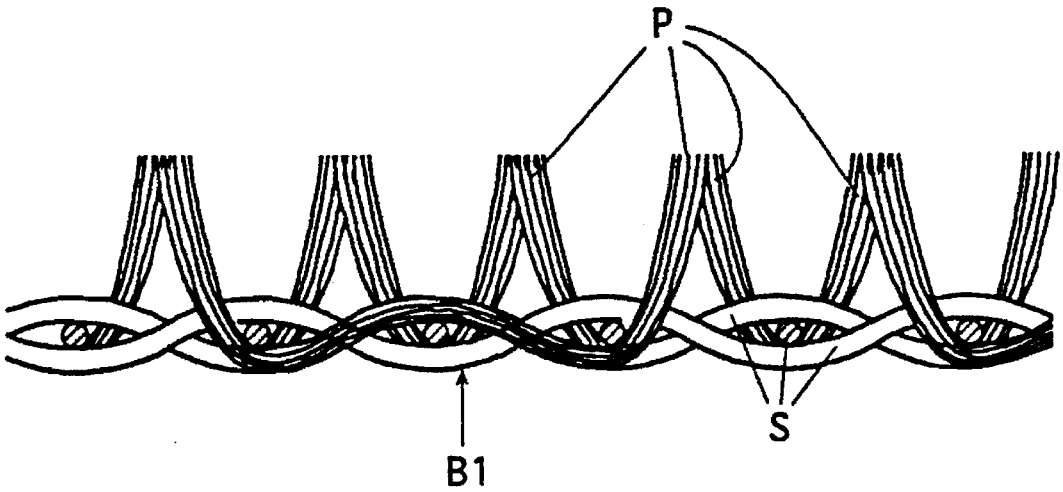
FIGS. 11(A) and 11(B) show an example of the brush member shown in FIG. 9(A) including piles woven into the base cloth in a W-shaped form, and more specifically, are a schematic cross section and a schematic plan of the brush member, respectively.
Figure 11:
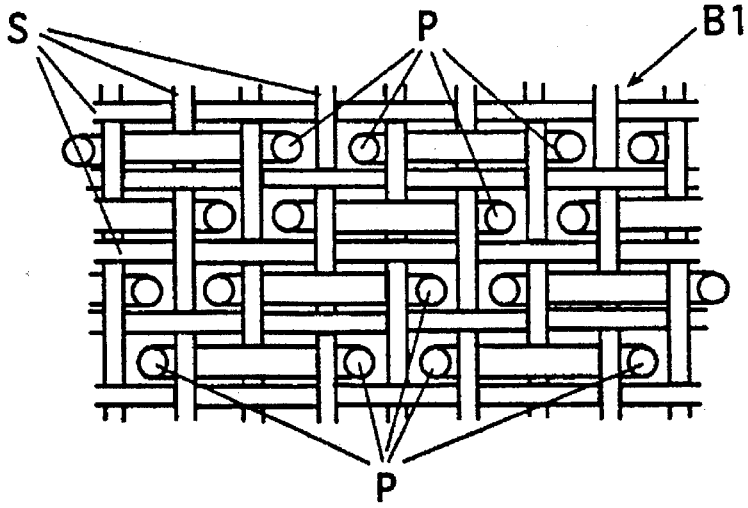

As modifications (employing different pile pitches) of the V-shaped weaving and W-shaped weaving shown in FIGS. 10(A) and 11(A), weaving manners shown in FIGS. 12(B)–12(F) may be employed.

In the manner shown in FIG. 12(B), the base cloth yarn S and the pile P are not parallel to each other. This cannot achieve a high productivity, but liquid applied to the rear side of the base cloth flows along the yarns in a complicated manner, so that the liquid can be applied uniformly in an easy manner. In the manner shown in FIG. 12(C), the piles P in the V-shaped weaving manner shown in FIGS. 10(A) and 10(B) are thinned out. In the manners shown in FIG. 12(D), the V-shaped weaving shown in FIG. 12(C) is employed, and the number of strings or yarns S of the base cloth engaged with the piles P is increased. In the manner shown in FIG. 12(E), the structure similar to that in FIG. 12(D) is employed, but the piles P are thinned in the longitudinal direction. In the manner shown in FIG. 12(F), the structure similar to that in FIG. 12(E) is employed, but the number of strings or yarns engaged with the piles P as well as the yarn space are different from those in FIG. 12(E). In the figures, CL indicates a mesh.

In addition to the above manners and structures, it is possible to employ structures having different pile pitches, which is achieved, e.g., by employment of two or more different weaving manners, use of a base cloth yarn having different diameters, or use of piles having different diameters.

The material of the brush fibers in the contact brush charging device may be selected in view of, e.g., the charging capability of the electrostatic latent image carrier, the surface hardness of the carrier, size of the carrier, the positional relationship between the charging device and other elements, and apparatus system speed. For example, in order to obtain an intended quantity of charges by applying the charging voltage such as a voltage formed of only a DC voltage or a voltage formed of superimposed DC and AC voltages, the material can be selected from various materials having appropriate electric resistance, flexibility, hardness, configuration and strength.

The electrically conductive metal brush fibers may be made of, e.g., tungsten, stainless steel, gold, platinum, aluminum, iron or copper, and may have a length and/or a diameter which are appropriately adjusted.

The electrically conductive resin material of the brush fibers may be rayon, polyamide, acetate, cuprammonium, vinylidene, vinylon, ethylene fluoride, benzoate, polyurethane, polyester, polyethylene, polyvinyl chloride, polypropylene or the like, and may contain resistance adjusting agent dispersed therein. The resistance adjusting agent may be carbon black, carbon fiber, metal powder, metal whiskers, metal oxide, semiconductor and others. An appropriate resistance may be obtained by adjusting the amount of the resistance adjusting agent dispersed in the fiber. Instead of dispersion, the surface of the fiber may be covered with the resistance adjusting agent.

The electrical resistance of the fiber material is generally set to a value of $10^9$ Ωcm or lower than that, and preferably value of $10^7$ Ωcm or lower than that for achieving a good charging performance.

The fiber may have a cross section allowing easy manufacturing such as a circular shape, elliptic shape, wavy circular shape, polygonal shape, flat shape or a hollow shape, provided that the intended charging properties can be maintained.

(2) With respect to support, rotation and others of the brush member

Figure 13:
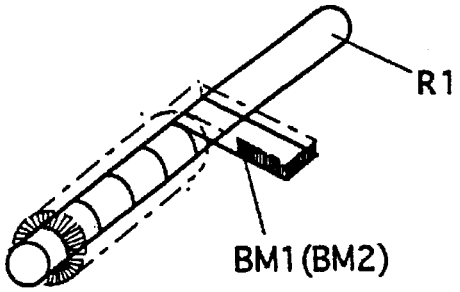
FIGS. 13(A) through 13(F) show examples of a manner of forming a rotary brush member or a fixed brush member from a brush member shown in FIG. 9(A) or FIG. 9(B)
Figure 13:
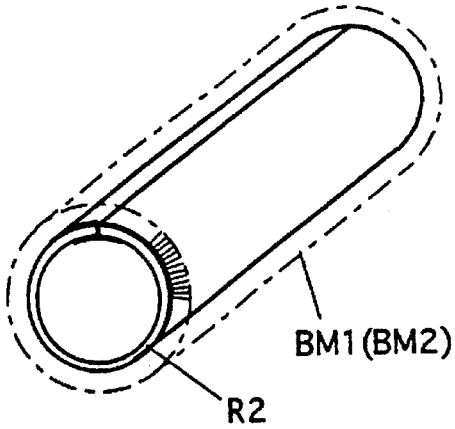
Figure 13:
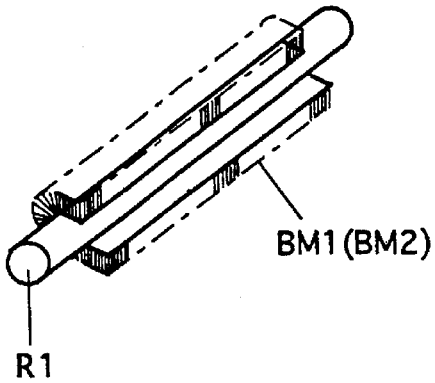
Figure 13:
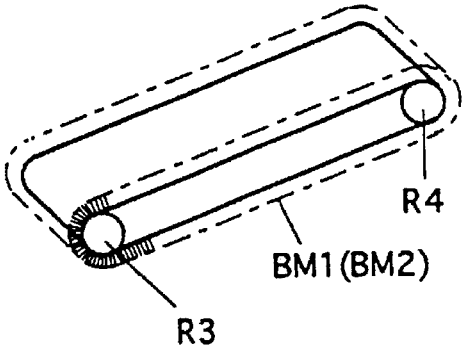
Figure 13:
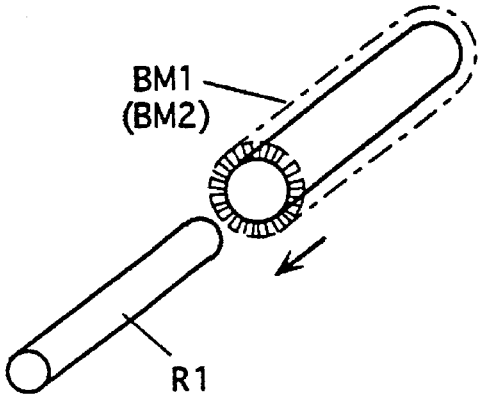
Figure 13:
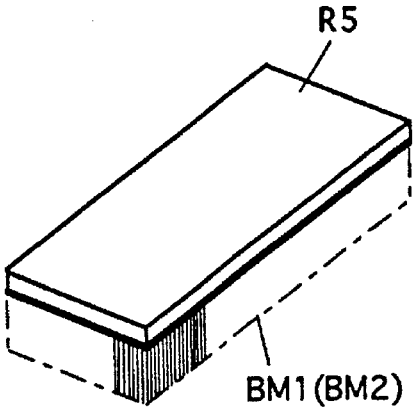

The brush members BM1 and BM2 shown in FIGS. 9(A) and 9(B) are provided as follows. An electrically conductive core rod R1 to be rotated is made of electrically conductive metal, electrically conductive synthetic resin, insulating material treated to have an electrically conductive surface, or the like. The brush member is spirally wound around the rod R1 as shown in FIG. 13(A), or is wound in a straight form as shown in FIG. 13(B) with electrically conductive adhesive therebetween. Alternatively, as shown in FIG. 13(C), the cylindrically shaped brush member is fitted around the rod with electrically conductive adhesive therebetween. Further alternatively, an electrically conductive plate member R2 is made of electrically conductive metal, electrically conductive synthetic resin, insulating material treated to have an electrically conductive surface, or the like is rounded into a cylindrical form, and the brush member is wound around the cylindrical member R2. The ends of the brush member are fixedly pinched between the mating edges of the plate member. The assembly thus formed is driven to rotate. In this case, electrically conductive adhesive may be used. Further, a structure shown in FIG. 13(E) may be employed, in which the brush member has an endless-strip-like form, and is retained around pulleys R3 and R4, at least one of which is driven to rotate, and at least one of which is made of electrically conductive metal, electrically conductive synthetic resin, insulating material treated to have an electrically conductive surface, or the like. Further, a structure shown in FIG. 13(F) may be employed, in which the brush member BM1 or BM2 having a predetermined area is adhered with electrically conductive adhesive to an electrically conductive base plate R5 made of electrically conductive metal, electrically conductive synthetic resin, insulating material treated to have an electrically conductive surface, or the like. Without using electrically conductive adhesive, insulating adhesive may be used in which case a rear end of the brush member is electrically connected to the base member for achieving an intended function as a brush.

The rotary brush or fixed brush thus formed is brought into contact with the surface of the electrostatic latent image carrier (photosensitive drum in the illustrated embodiments) PC as exemplified in FIGS. 14(A) through 14(E).

Figure 14:
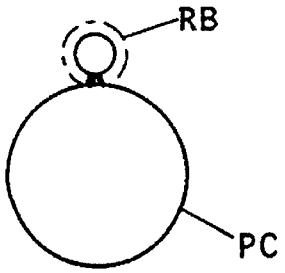
FIGS. 14(A) through 14(E) show examples of a form for contacting the rotary brush member or the fixed brush member shown in FIGS. 13(A) through 13(F) with a photosensitive member.
Figure 14:
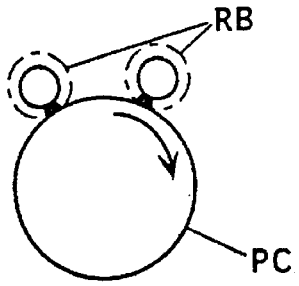
Figure 14:
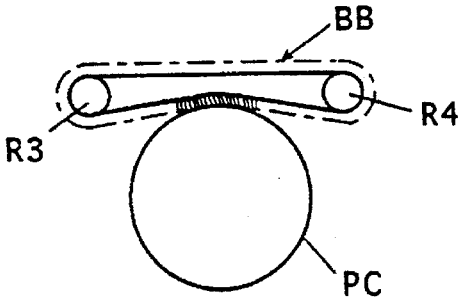
Figure 14:
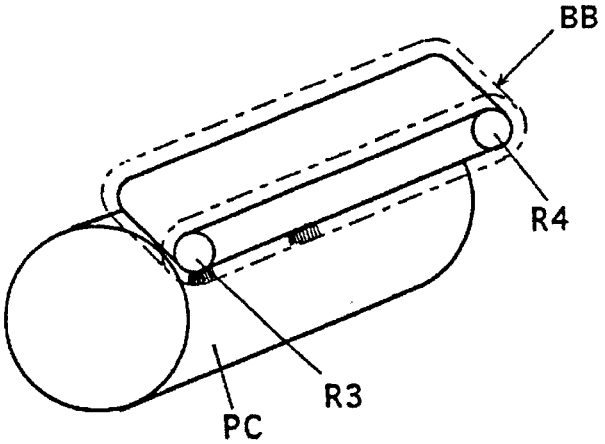
Figure 14:
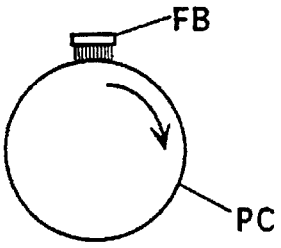

FIG. 14(A) shows a state that one rotary brush RB of a roller type is in contact with the photosensitive drum PC. FIG. 14(B) shows a state that two rotary brushes RB of a roller type are in contact with the photosensitive drum PC. In this case where multiple rotary brushes are in contact with the photosensitive drum, it is necessary only to apply the foregoing condition of $0.44 \leqq Lmin/Lmax \leqq 1$ to the brush at the most upstream position in view of the moving direction of the surface of the electrostatic latent image carrier.

FIG. 14(C) shows a state that a rotary brush BB of a belt type is arranged such that line connecting the pulleys R3 and R4 carrying the brush BB is perpendicular to the axis of rotation of the photosensitive drum PC. FIG. 14(D) shows a state that the rotary brush BB of the belt type is arranged such that line connecting the pulleys R3 and R4 carrying the brush BB is parallel to the axis of rotation of the photosensitive drum PC. FIG. 14(E) shows a state that a brush FB of a fixed type is in contact with the photosensitive drum PC. Likewise the foregoing condition can be applied to these structures.

(3) In the brush charging device of the contact brush type, the minimum distance Lmin and the maximum distance Lmax of the space between the adjacent bundles of the brush fibers are determined as follows.

As exemplified in FIGS. 15 through 19, it is assumed that "A" designates a certain brush fiber bundle including brush fibers projecting from the same position of the brush member, and a polygon passing through a brush fiber bundle B nearest to the bundle A is determined around the bundle A. In this case, it is determined that Lmin indicates the minimum distance from the bundle A at the center of the polygon to the bundle B nearest to the bundle A among the brush fiber bundles on the polygonal line, and Lmax indicates the distance from the bundle A to the bundle C remotest from the bundle A among the brush fiber bundles on the polygonal line. The foregoing polygon is determined to have no internal corner of 180 degrees or more in angle and to have the maximum area. For example, in the example shown in FIG. 15, a polygon indicated by solid line has a larger area than a polygon (triangle) indicated by alternate long and short dash line, so that the polygon indicated by solid line is selected. Further, it is determined that any brush fiber bundle other than the bundle A does not exist within the polygon.

If there are two or more polygons satisfying the above conditions, the largest Lmax is selected as Lmax.

(4) With respect to applied AC ingredient

Figure 20:
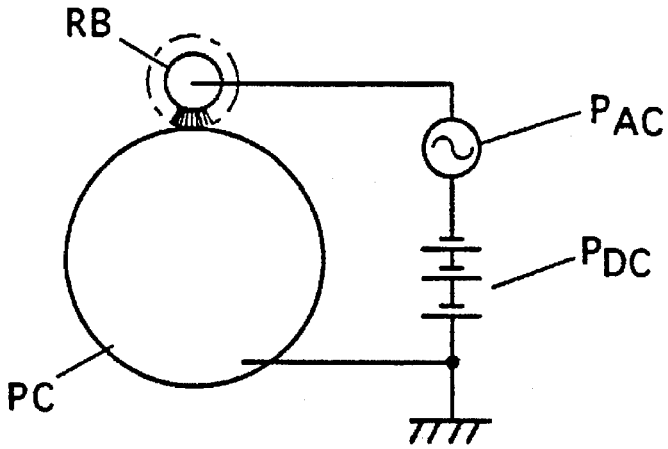
FIG. 20 shows an example of a structure of a power source for applying a charging voltage formed of a DC voltage and an AC voltage superimposed thereon to a brush charging device.
Figure 21:
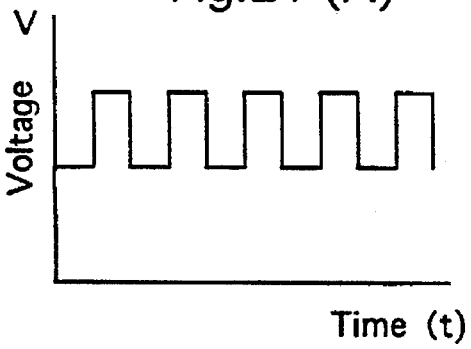
FIGS. 21(A) through 21(H) show examples of a waveform of an AC ingredient applied to a charging device.
Figure 21:
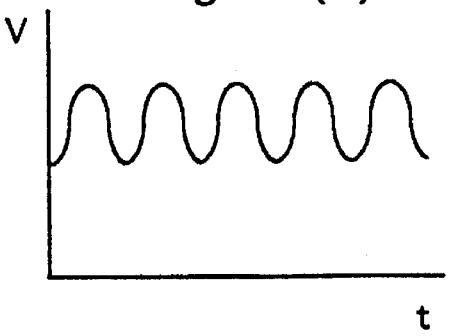
Figure 21:
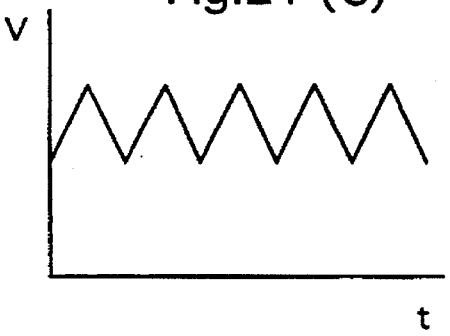
Figure 21:
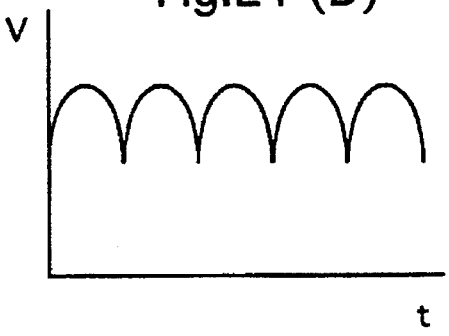
Figure 21:
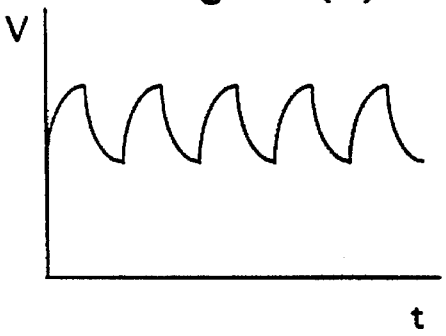
Figure 21:
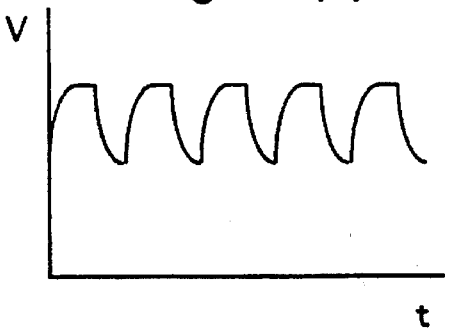
Figure 21:
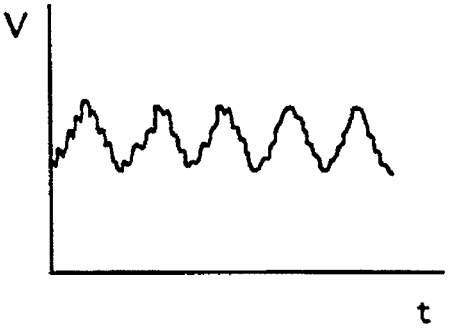
Figure 21:
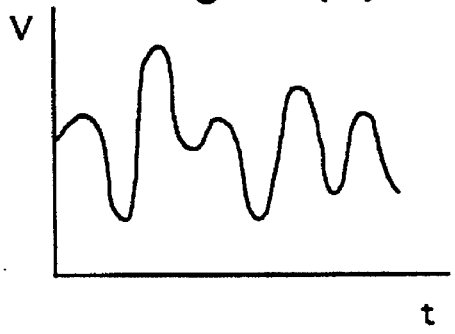

In connection with charging of the electrostatic latent image carrier, application of the charging voltage containing AC ingredient to the brush charging device can generally achieve more stable charging than the application of a mere DC voltage. Accordingly, in the image forming apparatus described here, the voltage applied to the brush charging device may be formed of superimposed AC and DC voltages supplied from an AC power source $P_{AC}$ and a DC power source $P_{DC}$ as exemplified in FIG. 20. In this case, the DC ingredient is generally selected from a voltage range from 300 V to 1500 V and its polarity is selected in accordance with the chargeable polarity of the electrostatic latent image carrier.

In connection with the AC ingredient, an alternating voltage to be applied generally has an amplitude selected from a peak-to-peak range from about 500 V to about 1500 V.

Naturally, the peak-to peak value of the AC ingredient as well as the frequency thereof are appropriately selected in view of a resistance of the rotary brush material, an electrostatic capacity of the brush member, a contact resistance between the rotary brush and the photosensitive drum, drive speeds of the rotary brush and photosensitive member and others, and generally the frequency is set to a value within a range from about 5 Hz to about 5000 Hz.

A waveform of the AC ingredient must be determined in view of factors related to the system, but is not particularly restricted. For example, as shown in FIGS. 21(A) through 21(H), it may be (A) square form, (B) sinusoidal form, (C) saw-tooth-like form, (D) half sinusoidal form, (E) saw-tooth-like form containing a time constant, F) square form containing a time constant, (G) form including a main waveform and a secondary waveform superimposed thereon, or (H) form containing a variable peak-to-peak.

(5) The electrostatic latent image carrier is typically a photosensitive member of a drum-like form or the like. The photosensitive member which can be employed in the invention may be a function-separated organic photosensitive member having a good sensitivity with respect to long-wave light beams such as semiconductor laser beams of 780 nm in wave length or LED light beams of 680 nm in wave length, which will be described later. However, a photosensitive member other than the above function-separated organic photosensitive member may be employed.

With respect to the sensitive range of the photosensitive member, the photosensitive member having the foregoing long wave sensitivity can be employed in an imaging system using long wave light beams from the semiconductor laser (780 nm) optical system or the LED array (680 nm) optical system. For example, a photosensitive member having an appropriate sensitivity with respect to a visible range can be used in the imaging system employing a liquid crystal shutter array, a PLZT shutter array or the like and utilizing visible light as the light source. Also the above photosensitive member may be used, for example, in an image forming system using a fluorescent illuminant array as the light source, an analog image forming system provided with a lens/mirror system and using visible light as generally used in conventional copying machines.

In connection with the structure of the photosensitive member, the member such as a function-separated organic photosensitive member including a charge transporting layer separately arranged on a charge generating layer, a photosensitive member of a so-called reversely layered type including a charge generating layer formed on a charge transporting layer, or a photosensitive member of a monolayer type including a single layer having a charge generating function and a charge transporting function can be employed. The charge generating material, charge transporting material, binding resin, additives and others may be appropriately selected from known materials. The photosensitive material is not restricted to an organic material, and may be inorganic material such as zinc oxide, cadmium sulfide, selenium alloy, amorphous silicone alloy, or amorphous germanium alloy.

The photosensitive member may be provided with a surface protective layer for improving a durability, anti-environment properties and others, and may be provided with an undercoating layer for improving a charging performance, image quality, adhesivity to the base member, and others. The surface protective layer and undercoating layer may be a thin-film made of ultraviolet-curing resin, cold setting resin, thermosetting resin, mixture resin containing the above resin and resistance adjusting agent in a dispersed manner, metal oxide, metal sulfide, or the like. The material is processed in a vacuum by a vaporization method, an ion plating method or the like into the thin-film form. Also, the layer may be an amorphous carbon film, an amorphous silicon carbide film, or the like produced by a plasma polymerization method.

The base member of the photosensitive member is not particularly restricted provided that its surface has an electrical conductivity. Other than a cylindrical form, it may have a flat form or a strip-like form. Further, surface roughening, oxidation, coloring or the like may be effected on the base member surface.

Figure 7:
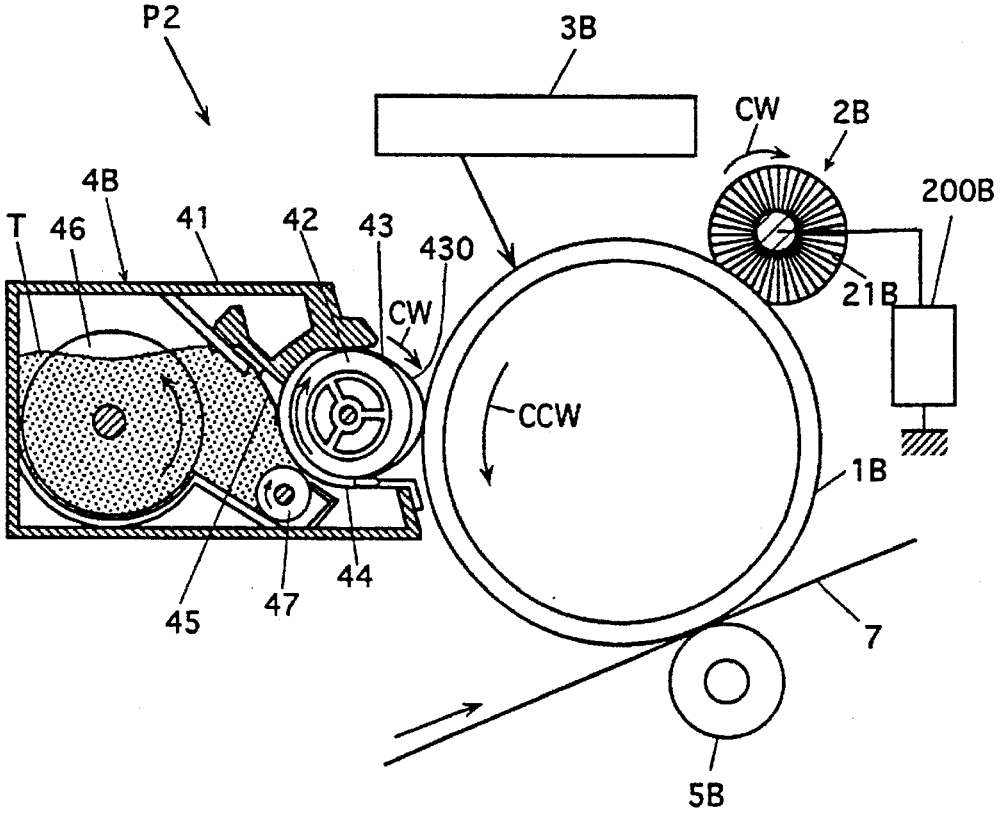
FIG. 7 schematically shows a structure of a major portion of another example of a printer according to the invention.

FIG. 7 schematically shows a structure of a printer provided with a charging device according to the invention. The printer P2 is provided at its central portion with a photosensitive drum 1B. The drum 1B is driven to rotate in a direction indicated by the arrow CCW in the figure (i.e., counterclockwise direction) by an unillustrated driving device. Around the drum 1B, there are sequentially disposed a brush charging device 2B, an exposing device 3B, a developing device 4B and a transfer charger 5B.

The brush charging device 2B includes a rotary brush 21B, and is in contact with the surface of the photosensitive drum 1B. The rotary brush 21B is supplied with a charging voltage from a power source 200B, and is driven to rotate oppositely to the photosensitive drum 1B by an unillustrated drive device, so that it is rotated to move in the same direction as the photosensitive drum surface at the contact area with the photosensitive drum 1B, and it can uniformly charge the surface of the photosensitive drum 1B to a potential from −500 to −1000 V.

The rotary brush 21B is of a roller type and includes the brush member of the type shown in FIG. 9(A), which is wound around an electrically conductive core roller and fixed thereto by electrically conductive adhesive making electrical connection therebetween. The brush member includes bundles of electrically conductive brush fibers woven into a base cloth. The minimum distance Lmin and the maximum distance Lmax between adjacent brush fiber bundles satisfy the relationship of $0.44 \leqq Lmin/Lmax \leqq 1$.

The exposing device 3B is of a known type using a semiconductor laser, and is adjusted to lower the potential of an image portion of the surface of the photosensitive drum 1B charged to −600 V to about −50 V with laser beam irradiation.

The developing device 4B is a mono-component developing device performing reversal developing, and has the substantially same structure and function as the developing device 4A in the printer P1 shown in FIG. 1. The same portions bear the same reference numbers as those of the device 4A.

The developing sleeve 43 is supplied with the developing bias voltage of −250 V from an unillustrated power source.

The photosensitive drum 1B is a negatively chargeable function-separated organic photosensitive member having a good sensitivity with respect to long wave light beams such as semiconductor laser light beams of 780 nm in wave length or LED light beams of 680 nm in wavelength, and is manufactured as follows.

Photosensitive liquid is prepared from τ-type non-metal phthalocyanine at 1 weight part, polyvinyl butyral resin at 2 weight parts and tetrahydrofuran at 100 weight parts. This liquid is kept in a ball mill pot for 24 hours to be dispersed. The photosensitive liquid thus manufactured has a viscosity of 15 cp at 20° C. The polyvinyl butyral resin has a degree of acetylation of 3 mol % or less, a butylated degree of 70 mol %, and a polymerization degree of 1000.

This liquid is applied to a surface of a cylindrical alumite base member having a diameter of 30 mm, a length of 240 mm and a thickness of 0.8 mm by a dipping method, and then is dried to form a charge generating layer of 0.4 μm in thickness. The cylindrical base member is made of aluminum alloy containing magnesium at 0.7 wt. % and silicon at 0.4 wt. %. The drying is carried out in circulating air at 20° C. for 30 minutes.

Then, liquid, which contains hydrazone compound having the following structural formula, is used:

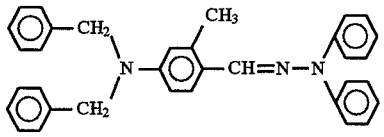

This liquid includes the above hydrazone compound at 8 weight parts, as well as orange pigment (Sumiplast Orange 12 manufactured by Sumitomo Kagaku Kabushiki Kaisha) at 0.1 weight part, and polycarbonate resin (Panlite L-1250 manufactured by Teijin Kasei Kabushiki Kaisha) at 10 weight parts which are dissolved into solvent of tetrahydrofuran at 180 weight parts. This liquid is applied to the charge generating layer by the dipping method, and then is dried to form the charge transmitting layer of 28 μm in thickness. The liquid thus manufactured has a viscosity of 240 cp at 20° C. The drying is carried out in circulating air at 100° C. for 30 minutes.

In this manner, the negatively chargeable organic photosensitive drum 1B of the function-separated type, which includes the charge generating layer and the charge transporting layer successively formed on the conductive base member, is manufactured.

The τ-metal free phthalocyanine used for manufacturing the charge generating layer exhibits strong peaks at Bragg angles (2θ±0.2 deg.) of 7.6, 9.2, 16.8, 17.4, 20.4 and 20.9, in the X-ray diffraction pattern obtained with CuKα/Ni X-ray having a wave length of 1.541Å. In particular, the infrared ray absorption spectrum thereof has four absorption bands, of which the strongest value is 751±2 $cm^{-1}$, between 700 $cm^{-1}$ and 760 $cm^{-1}$, two absorption bands of a substantially equal strength between 1320 $cm^{-1}$ and 1340 $cm^{-1}$, and a characteristic absorption band at 3288±3 $cm^{-1}$.

The developing device 4B use the following toner T.

The toner is of a negatively chargeable type, and is nontransparent and nonmagnetic black toner formed from the following composition. The composition is formed of bisphenol A polyester resin at 100 weight parts, carbon black (MA#8 manufactured by Mitsubishi Kasei Kogyo Kabushiki Kaisha) at 5 weight parts, charge control agent (Bontron S-34 manufactured by Orient Kagaku Kogyo Kabushiki Kaisha) at 3 weight parts, and wax (Viscorl TS-200 manufactured by Sanyo Kasei Kogyo Kabushiki Kaisha) at 2.5 weight parts. This composition is kneaded, ground and classified by a known method to manufacture toner particles having a mean diameter of 10 μm and a distribution, in which 80 weight percents are included in a range of the particle diameters from 7 μm to 13 μm. Hydrophobic silica (Tanolux 500 manufactured by Gabojil Co.) at 0.75 weight percents is added as fluidization agent to the toner particles, and mixed and agitated by a homogenizer.

The image forming apparatus according to the invention may use the developer and developing method other than those already described. In accordance with the polarity of the photosensitive member and the image forming process, it is possible to select appropriately the positively chargeable toner, transparent toner, magnetic toner, two-component developing method or normal (regular) developing method. In connection with the color, it is possible to select appropriately, in addition to the black toner, color toner of yellow, magenta, cyan or the like. The toner may be of an indeterminate shape, or a specific shape such as spherical shape. In order to improve the cleaning performance, lubricant such as polyvinylidene fluoride may be mixed thereinto.

Figure 8:
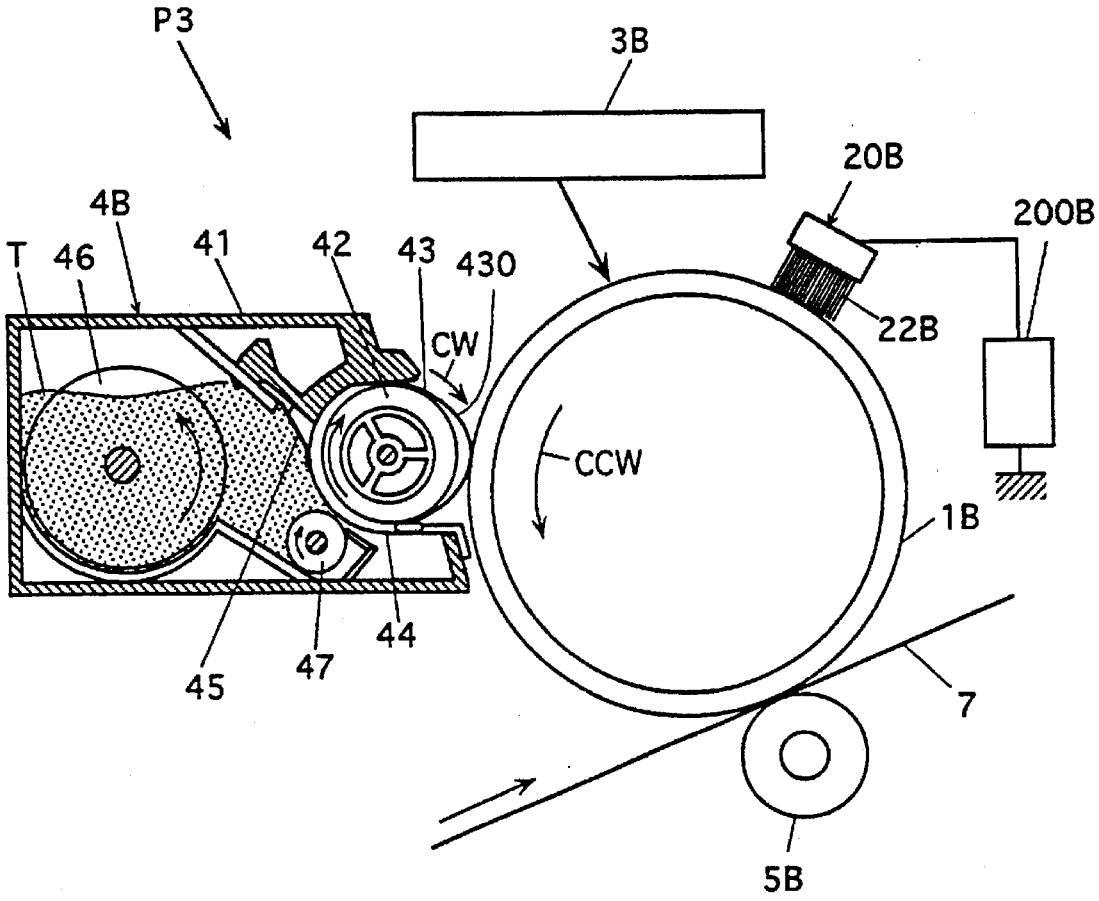
FIG. 8 schematically shows a structure of a major portion of still another example of a printer according to the invention.

FIG. 8 schematically shows a structure of another printer provided with a charging device according to the invention.

The printer P3 differs from the printer P2 shown in FIG. 7 in that the charging device 2B is replaced with a contact charging device 20B provided with a charging member formed of a fixed brush 22B of a type shown in FIG. 13(F). Other structures are substantially the same as those in the printer P2 in FIG. 7, and the substantially same parts and portions bear the same reference numbers. The toner used in the developing device 4B are the same as that already described.

In the fixed brush 22B of the charging device 20B, the brush member includes bundles of electrically conductive fibers woven into the base cloth. The minimum distance Lmin and the maximum distance Lmax between adjacent brush fiber bundles satisfy the relationship of $0.44 \leqq Lmin/Lmax \leqq 1$.

According to the printers P2 and P3 described above, the surface of the photosensitive drum 1B driven to rotate is uniformly charged by the brush charging devices 2B and 20B to have the surface potential of −600 V, and subsequently the exposing device 3B performs the image exposure to form the electrostatic latent image. The surface potential of the exposed portion lowers to about −50 V. The electrostatic latent image thus formed is developed into the toner image by the developing device 4B with the developing bias voltage of −250 V. In this developing, the toner T on the developing sleeve 43 adheres onto the electrostatic latent image with the potential difference of ΔV of 200 V.

The toner image thus formed is transferred onto the sheet 7 supplied from the unillustrated transfer sheet supply unit by the transfer charger 5B. The sheet 7 is separated from the photosensitive drum 1B by a known separating unit (not shown) after the transfer, and moves to the unillustrated fixing device, by which the toner image is fixed before discharging the sheet.

However, the toner on the photosensitive drum 1B is not entirely transferred onto the sheet 7 by the transfer charger 5B, but 10–20% of the toner generally remains as the residual toner on the photosensitive drum 1B. The residual toner is charged by the charging device 2B and 20B, and, if necessary, it passes through the stage for image exposure by the exposing device 3B. Then, the residual toner on the non-image portion is collected into the developing sleeve 43. Namely, the residual toner on the non-image portion of the photosensitive drum 1B is forced to move toward the developing sleeve 43 by a potential difference of about 350 V, and simultaneously the developing sleeve 43 applies a scraping effect on the residual toner, so that the residual toner is collected toward the developing sleeve 43.

In the case where charging and exposure are effected without removing the residual toner on the photosensitive drum, a portion covered with the residual toner may be neither charged nor exposed. However, the problem is not caused in the printers p2 and p3 because the rotary brush 21B and fixed brush 22B of the brush charging device 2B and 20B scatter the residual toner. If a contact charging device such as a corona charger, a charging roller or a charging blade is used, a scattering member is required. However, the brush charging device can scatter the toner, so that the scattering member is not required.

Since the printers P2 and P3 satisfy the relationship of $0.44 \leqq Lmin/Lmax \leqq 1$, it is possible to suppress grouping of brush fibers of the charging brushes 21B and 22B due to adhesion of the residual toner on the photosensitive drum 1, so that the photosensitive drum 1 can be charged uniformly to form the image of a high quality, in which image irregularity is suppressed.

Experiments were performed for image evaluation with the printers P2 and P3. The charging voltage applied to the contact charging devices 2B and 20B as well as a material, thickness and others of the brush fiber of the charging device were determined in accordance with the following common conditions 1, 2 and 3. The arrangement of the brush fiber bundles satisfied the relationship of $0.44 \leqq Lmin/Lmax \leqq 1$. As examples for comparison, images were also formed with the range other than the range of $0.44 \leqq Lmin/Lmax \leqq 1$.

Figure 22:
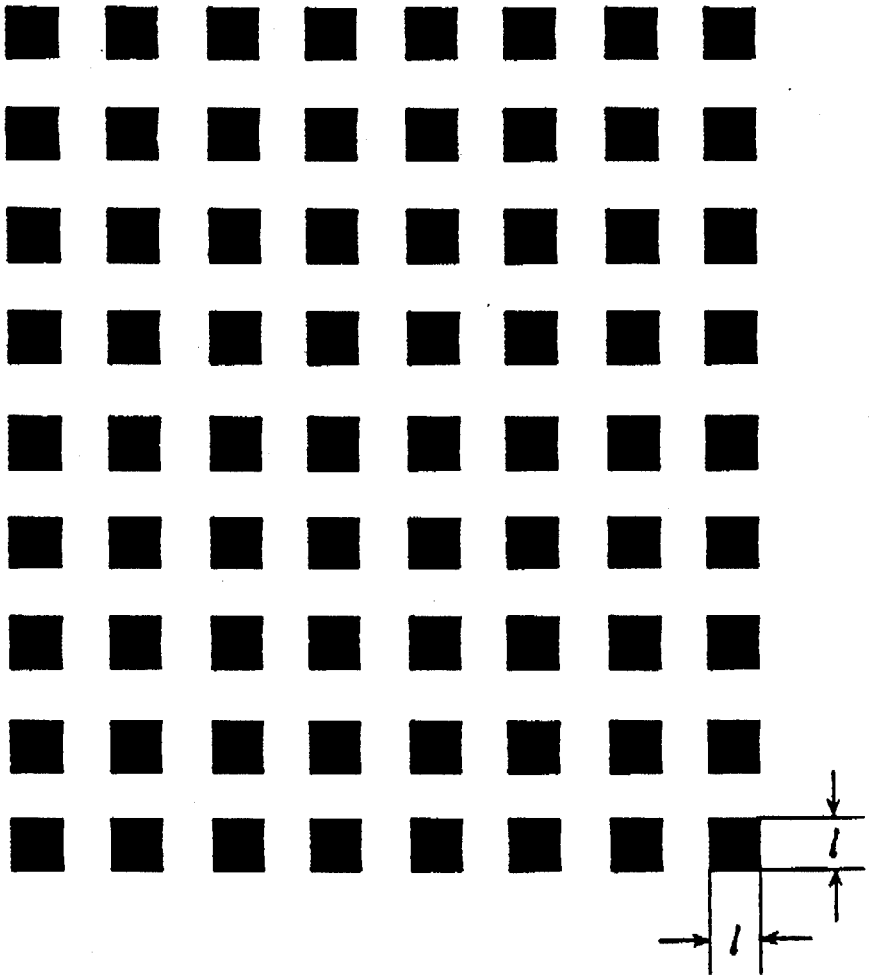
FIG. 22 shows an example of a mesh pattern.

The images to be evaluated were formed by the above printers after printing character patterns of a B/W ratio of 5% on 500 sheets. The image to be evaluated was a mesh image of one-on/three-off at a density of 300 dpi as shown in FIG. 22. The image irregularity was evaluated in accordance with the following five ranks ((1)–(5)). In FIG. 22, a normal length 1 of one side of one dot was 84.7 μm.

(1) Visible image irregularity was conspicuously found, and the image was not practically acceptable.

(2) Visible image irregularity was found, and the image was not practically acceptable.

(3) Visible image irregularity was found, but the image was practically acceptable.

(4) Visible image irregularity was slightly found, but the image irregularity was practically ignorable.

(5) Any visible image irregularity was not found, and the image was good.

In the case of the following common conditions 1 of the brush charging device

The printer P2 was employed, and the rotary brush 21B of the charging device 2B was supplied with the charging voltage including a DC voltage and an AC voltage superimposed thereon as already described. The DC ingredient was −600 V, and the AC ingredient was 1.5 kV and 100 Hz in frequency.

The rotating direction of the rotary brush 21B was opposite to that of the photosensitive drum 1B as already described. Therefore, contact portions of them moved in the same direction.

Thickness of brush fiber: 6 deniers (600d/100f)

Brush fiber material: rayon containing conductive carbon dispersed therein

Brush resistance: $10^6$–$10^7$ Ωcm

Brush fiber length: 5 mm

Pressed-in length of brush fibers to drum 1B: 1 mm

Rotation speed of rotary brush 21B: triple the rotation speed of the photosensitive drum Experimental Example b1

Figure 15:
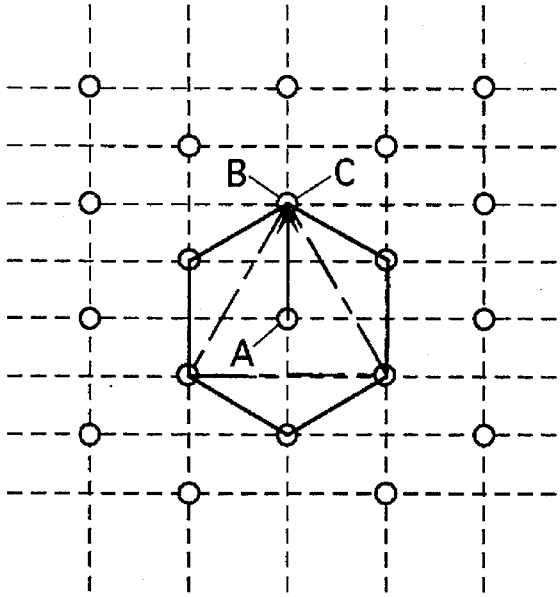
FIG. 15 shows a manner of determining a maximum value Lmax and a minimum value Lmin of an inter-bundle space of brush fiber bundles in the charging brush.

The rotary brush used in this example had the brush fiber bundles arranged as shown in FIG. 15. The brush bundle space was set to satisfy Lmin/Lmax=1.0. The evaluated rank of the image formed with this brush was (5).

Experimental Example b2

Figure 16:
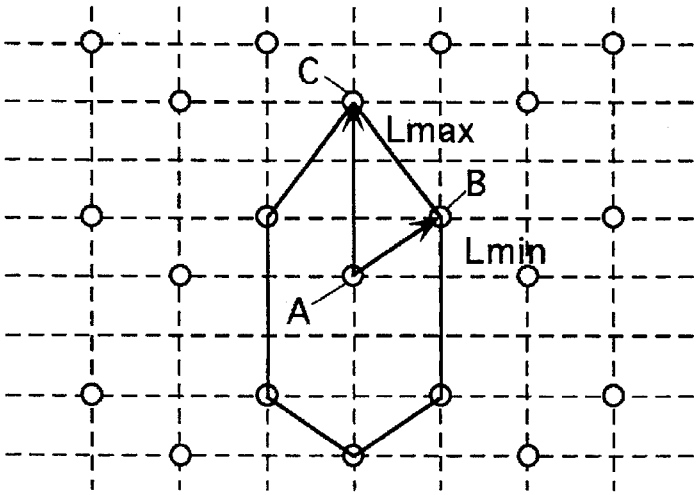
FIG. 16 shows a manner of determining a maximum value Lmax and a minimum value Lmin in the charging brush including brush fiber bundles fixed in a manner different from that in FIG. 15.

The rotary brush used in this example had the brush fiber bundles arranged as shown in FIG. 16. The brush bundle space was set to satisfy Lmin/Lmax=0.6. The evaluated rank of the image formed with this brush was (5).

Experimental Example b3

Figure 17:
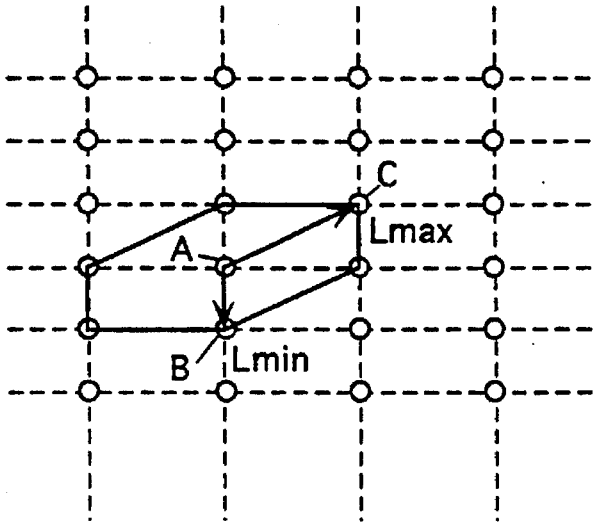
FIG. 17 shows a manner of determining a maximum value Lmax and a minimum value Lmin in the charging brush including brush fiber bundles fixed in a further different manner.

The rotary brush used in this example had the brush fiber bundles arranged as shown in FIG. 17. The brush bundle space was set to satisfy Lmin/Lmax=0.44. The evaluated rank of the image formed with this brush was (3).

Example for Comparison b1

Figure 18:
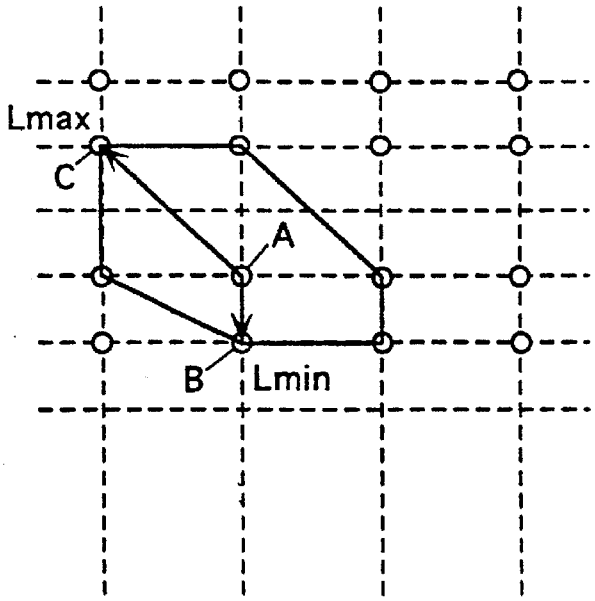
FIG. 18 shows a manner of determining a maximum value Lmax and a minimum value Lmin in the charging brush including brush fiber bundles fixed in a further different manner.

The rotary brush used in this example had the brush fiber bundles arranged as shown in FIG. 18. The brush bundle space was set to satisfy Lmin/Lmax=0.40. The evaluated rank of the image formed with this brush was (2).

Example for Comparison b2

Figure 19:
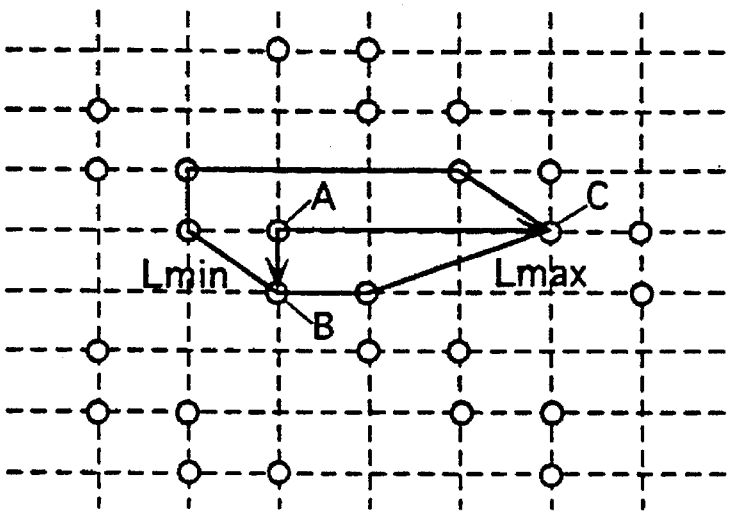
FIG. 19 shows a manner of determining a maximum value Lmax and a minimum value Lmin in the charging brush including brush fiber bundles fixed in a further different manner.

The rotary brush used in this example had the brush fiber bundles arranged as shown in FIG. 19. The brush bundle space was set to satisfy Lmin/Lmax=0.20. The evaluated rank of the image formed with this brush was (2).

In the case of the following common conditions 2 of the brush charging device

The printer P2 or P3 is employed and the rotary brush 21B or fixed brush 22B of the charging device 2B or 20B was supplied with the charging voltage which did not include an AC ingredient but included only a DC voltage of −1100 V. Other conditions were the same as the common conditions 1.

Experimental Example b4

The printer P2 was used. The rotary brush 21B used in this example had the brush fiber bundles arranged as shown in FIG. 15. The brush bundle space was set to satisfy Lmin/Lmax=1.0. The evaluated rank of the image formed with this brush was (5).

Experimental Example b5

The printer P2 was used. The rotary brush 21B used in this example had the brush fiber bundles arranged as shown in FIG. 16. The brush bundle space was set to satisfy Lmin/Lmax=0.6. The evaluated rank of the image formed with this brush was (4).

Experimental Example b6

The printer P2 was used. The rotary brush 21B used in this example had the brush fiber bundles arranged as shown in FIG. 17. The brush bundle space was set to satisfy Lmin/Lmax=0.44. The evaluated rank of the image formed with this brush was (3).

Example for Comparison b3

The printer P3 was used. The fixed brush 22B used in this example had the brush fiber bundles arranged as shown in FIG. 18. The brush bundle space was set to satisfy Lmin/Lmax=0.4. The evaluated rank of the image formed with this brush was (2).

Example for Comparison b4

The printer P2 was used. The rotary brush 21B in this example had the brush fiber bundles arranged as shown in FIG. 19. The brush bundle space was set to satisfy Lmin/Lmax=0.2. The evaluated rank of the image formed with this brush was (1).

In the case of the following common conditions 3 of the brush charging device

The printer P3 was employed, and the fixed brush 22B of the charging device 20B was supplied with the charging voltage including a DC voltage and an AC voltage superimposed thereon as already described. The DC ingredient was −600 V, and the AC ingredient was 1.5 kV and 100 Hz in frequency.

Thickness of brush fiber: 6 deniers (600d/100f)

Brush fiber material: rayon containing conductive carbon dispersed therein

Brush resistance: $10^6$–$10^7$ Ωcm

Brush fiber length: 5 mm

Pushed-in length of brush fiber to drum 1B: 1 mm

Experimental Example b7

The fixed brush used in this example had the brush fiber bundles arranged as shown in FIG. 15. The brush bundle space was set to satisfy Lmin/Lmax=1.0. The evaluated rank of the image formed with this brush was (4).

Experimental Example b8

The fixed brush used in this example had the brush fiber bundles arranged as shown in FIG. 17. The brush bundle space was set to satisfy Lmin/Lmax=0.44. The evaluated rank of the image formed with this brush was (3).

Example for Comparison b5

The fixed brush used in this example had the brush fiber bundles arranged as shown in FIG. 18. The brush bundle space was set to satisfy Lmin/Lmax=0.40. The evaluated rank of the image formed with this brush was (1).

From the above results, it can be found that the relationship of Lmin/Lmax≧0.44 can reduce or prevent the charging irregularity and can produce good images. The relationship of Lmin/Lmax≧0.6 is particularly preferable. The rotary brushes can achieve better results than the fixed brushes.

(Fourth Embodiment)

A fourth embodiment of the invention will now be described below.

An image forming apparatus to be described later is of a simultaneous developing/cleaning type, and employs, as the charging device for charging the surface of the photosensitive member, a contact charging device having a charging rotary brush. The rotary brush includes a fiber-set cloth, which is provided with electrically conductive brush fibers fixed to a base cloth, and is wound around a core rod or roller.

Assuming that m (fibers/$mm^2$) represents the number of brush fibers of the rotary brush which are brought into contact with a unit area of the photosensitive member surface during passing thereof through the contact nip formed with respect to the photosensitive member, a condition of 350<m<4000 is satisfied.

The image forming apparatus of the above type can particularly suppress reduction of durability of the photosensitive member by preventing shaving of the surface of the photosensitive member, and can also suppress variation of the charged potential of the photosensitive member due to environmental variation. Further, the apparatus can sufficiently suppress generation of a memory by sufficiently scattering the untransferred residual developer with the charging rotary brush.

The above number m is represented as follows.

Figure 24:
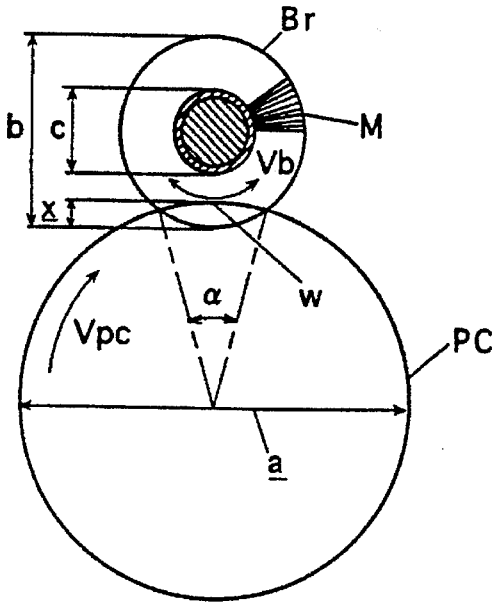
FIG. 24 shows a manner of determining a formula for calculating a value m.

It is assumed that a charging rotary brush Br is in contact with a photosensitive member PC as shown in FIG. 24, and specifications are as follows:

An outer diameter of the photosensitive member PC is a (mm).

An outer diameter of the rotary brush Br is b (mm).

An outer diameter of the core roller including the base cloth of the rotary brush Br is c (mm)

A pressed-in length of the rotary brush Br with respect to the photosensitive member PC is x (mm)

A width of the contact nip between the surface of the photosensitive member and the rotary brush Br in the moving direction of the surface is w (mm). ($w=\alpha\cdot a/2$, where α is a central angle of the nip on the photosensitive member in the length along the periphery of the photosensitive member.)

A peripheral velocity of the photosensitive member PC is Vpc.

A peripheral velocity of the rotary brush Br is Vb.

A peripheral velocity ratio (Vb/Vpc) is θ.

An average brush fiber density on the base cloth is M (fibers/$mm^2$).

The following formula represents the number m of brush fibers of the rotary brush Br which are brought into contact with a unit area (1 $mm^2$) of the photosensitive member surface during passing thereof through the contact nip:

m=(peripheral velocity difference)×(time required for passing through the contact nip of the photosensitive member and the rotary brush)×(brush fiber density at the rotary brush surface)

$=|\theta-1|\cdot Vpc\cdot(w/Vpc)\cdot(M\cdot c/b)$ $=c/b\cdot w\cdot(|\theta-1|)\cdot M$ The value m does not depend on the system speed (equal to the peripheral velocity of the photosensitive member). It is also assumed that θ is positive if the rotation direction of the brush Br is opposite to that of the photosensitive member PC (mutually contact portions move in the same direction), and is negative if both the rotation directions are the same (mutually contact portions move in the opposite directions).

The value of m affects an effect of scattering the untransferred residual developer. If m is equal to 350 or more, the larger value can achieve the scattering of untransferred residual toner more effectively. However, in the image forming apparatus of the cleanerless type, m equal to 4000 or more causes the following two serious problems:

(1) deterioration of durability of the photosensitive member due to shaving of the surface film on the photosensitive member, and (2) variation of the charged potential of the photosensitive member due to environmental variation.

The above problem (2) will be described below more in detail. The charging of the photosensitive member by the rotary brush is mainly affected by the followings:

(1) discharging at a minute gap between the conductive brush fibers and the photosensitive member surface (no dependency on the environment), and (2) introduction of charges from the conductive brush fibers to the photosensitive member surface (large dependency on the environment)

If the value m is lower than about 4000, the charging is mainly performed by the above (1), so that the problem does not arise. However, if the value m is larger than 4000, charging by the above (2) cannot be ignored, because the quantity of introduced charges is substantially proportional to the number of contact brush fibers. Further, the above (2) is significantly affected by the environment, so that the surface potential of the photosensitive member varies due to the environmental variation, resulting in variation of the image density due to the environmental variation.

The above problems (1) and (2) do not arise in a system in which a dedicated cleaning device is provided and the rotary brush has only the charging function, even if m is larger than 8000.

In the image forming apparatus of the simultaneous developing/cleaning type, however, if it is intended to scatter the untransferred residual developer by the charging rotary brush, the maximum value of m must be 4000 in order to prevent both the above problems (1) and (2). The reason for this has not been specifically clarified, but can be presumed as that, with respect to the problem (1), toner particles function as abrasives and, with respect to the problem (2), absorption of humidity by the developer layer reduces a contact resistance, so that introduction of charges from the brush fibers into the photosensitive member is promoted, because the charging rotary brush slides on the photosensitive member surface covered with the residual toner layer.

Ranges of the foregoing c, b, w, θ, M satisfying the relationship of $350<m<4000$ are as follows:

The value b is in a range from 10 mm to 30 mm.

If it is smaller than 10 mm, it is difficult to make uniform contact of the rotary brush with the photosensitive member, resulting in irregular charging of the photosensitive member and irregular scattering of the untransferred residual developer. If it is larger than 30 mm, sizes of the image forming apparatus cannot be sufficiently reduced, and a large amount of brush fibers are required, resulting in increase of the cost.

The value c is in a range from 4 mm to 13 mm.

If it is smaller than 4 mm, the rotary brush cannot have a sufficient strength, and the core roller of the rotary brush is deformed, so that it is difficult to make uniform contact between the brush and the photosensitive member. If it is larger than 13 mm, the sizes of the image forming apparatus cannot be reduced sufficiently, and a large amount of brush fibers are required, resulting in increase of the cost.

The value w is in a range from 2 mm to 15 mm.

If it is smaller than 2 mm, it is difficult to make uniform contact between the rotary brush and the photosensitive member, so that irregular charging and irregular scattering of the untransferred residual developer occur. If it is larger than 15 mm, an electric motor having a large torque is required for driving the rotary brush, resulting in increase of the cost. Further, the photosensitive member is shaved to a higher extent.

The value $|\theta|$ is in a range from 0.5 to 10.

If it is smaller than 0.5, irregular charging occurs at the photosensitive member, and it is difficult to achieve an intended effect of scattering the untransferred residual toner. If it is larger than 10, an electric motor having a large torque is required for driving the rotary brush, resulting in increase of the cost. Further, the photosensitive member is shaved to a higher extent.

The value M is in a range from 23 (fibers/mm$^2$) {i.e., 15000 (fibers/square inch)} to 310 (fibers/mm$^2$) {i.e., 200000 (fibers/square inch)}.

If it is smaller than 23 (fibers/mm$^2$), irregular charging occurs at the photosensitive member, and it is difficult to achieve an intended effect of scattering the untransferred residual toner. If it is larger than 310 (fibers/mm$^2$), each brush fiber must have an excessively small diameter, so that its strength excessively decreases to cause drop and disengage of the fiber, which cases noises.

The structure of the charging rotary brush includes the fiber-set cloth (here, BM1), which is provided with the electrically conductive brush fibers fixed to the base cloth and is fixed around the core roller, as already described. More specific example will be described below. An electrically conductive core roller (here, R1) having a circular section is made of electrically conductive metal, electrically conductive synthetic resin or insulating material treated to have an electrically conductive surface. The cloth BM1 may be spirally wound around the roller R1 and fixed with electrically conductive adhesive thereto similarly to that shown in FIG. 13(A), or straightly wound around the roller R1 and fixed with electrically conductive adhesive thereto similarly to that shown in FIG. 13(B), or it may be shaped cylindrically, and then may be fitted and fixed onto the roller R1 with electrically conductive adhesive similarly to that shown in FIG. 13(C). Further, similarly to that shown in FIG. 13(D), the following structure may be employed. An electrically conductive plate member R2 is made of electrically conductive metal, electrically conductive synthetic resin, insulating material treated to have an electrically conductive surface, or the like is rounded into a cylindrical form, and the cloth is wound around the cylindrical member R2. The ends of the cloth are fixedly pinched between the mating edges of the plate member. The assembly thus formed is driven to rotate. In this case, electrically conductive adhesive may be used.

The material of the brush fiber is selected to obtain an intended charge amount, and can be selected from various materials having appropriate electric resistance, flexibility, hardness, configuration and strength, similarly to the brush fiber material already described in connection with the second and third embodiments.

In the case where the electrically conductive metal brush fibers or the electrically conductive resin brush fibers are employed, the material and the electric resistance of the fibers may be selected similarly to those of the second and third embodiments.

The fibers may have sections similarly to those of the second and third embodiments.

The photosensitive member may be selected specifically from various photosensitive members similarly to that of the second and third embodiments.

With respect to the developing device, developer and developing method, as will be described later, the mono-component developing device using the mono-component developer formed of toner may be employed, and the reversal developing may be performed with the toner of a negatively chargeable nontransparent type, and nonmagnetic black toner. The developer and developing method which can be employed in the image forming apparatus according to the invention are not restricted to them.

Similarly to the second and third embodiments, the toner may be appropriately selected from the positively chargeable toner, transparent toner and magnetic toner in accordance with the polarity of the photosensitive member and the image forming process to be used. In connection with the color, it is possible to select appropriately, in addition to the black toner, color toner of yellow, magenta, cyan or the like. The toner may be of an indeterminate shape, or a specific shape such as spherical shape. In order to improve the cleaning performance, lubricant such as polyvinylidene fluoride may be mixed thereinto. The developing method may be appropriately selected from two-component developing method, regular developing method and others.

Figure 23:
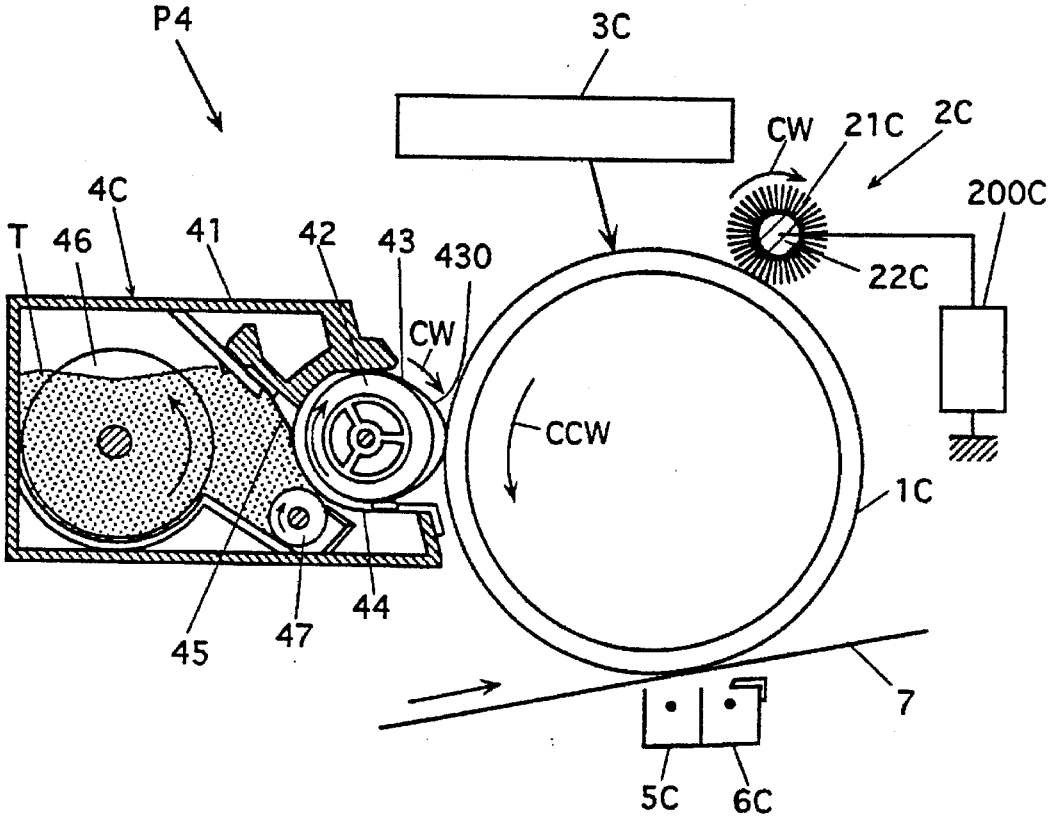
FIG. 23 shows a schematic structure of further another example of a major portion of a printer according to the invention.

FIG. 23 schematically shows a structure of a major portion of a laser beam printer P4 of a fourth embodiment of the invention. This printer P4 is prepared by remodeling a printer SP-101 manufactured by Minolta Co., Ltd.

The printer P4 is provided at its central portion with a photosensitive drum 1C. The drum 1C is driven to rotate in a direction indicated by the arrow CCW in the figure (i.e., counterclockwise direction) by an unillustrated driving device. Around the drum 1C, there are sequentially disposed a contact charging device 2C, an exposing device 3C, a developing device 4C, a transfer charger 5C, and a separating charger 6C.

Similarly to the structure shown in FIG. 13(A), the contact charging device 2C includes a roller-like charging rotary brush 21C, in which a fiber-set cloth including many electrically conductive brush fibers fixed to a base cloth is spirally wound around an electrically conductive core roller 22C (see FIG. 23) having a circular section. The rotary brush 21C is in contact with the photosensitive drum 1C and is driven to rotate clockwise in the figure. A power source 200C applies a voltage, which is formed of a DC voltage of −800 V and a superimposed AC voltage having a frequency of 100 Hz and amplitude of −1 kV, to the brush 21C for charging the surface of the photosensitive drum 1C to −800 V. The brush fibers forming the rotary brush 21C are rayon yarn brush fibers produced by wet spinning, which is a normal method for fiber production. Before spinning, an electrically conductive agent mainly formed of an electrically conductive carbon may be appropriately mixed into the material for setting the electrical resistance to $10^6$ Ωcm after the spinning.

As already described, the following formula represents the number m (fibers/mm$^2$) of brush fibers of the rotary brush 21C which are brought into contact with a unit area (1 mm$^2$) of the photosensitive member surface during passing thereof through the contact nip:

$$m=(c/b)\cdot w\cdot|\theta-1|\cdot M$$

The values of c, b, w, θ and M are set to satisfy the relationship of 350<m<4000.

In the above case, c is in a range from 4 to 13 mm, b is in a range from 10 to 30 mm, w is in a range from 2 to 15 mm, |θ| is in a range from 0.5 to 10, and M is in a range from 23 to 310 (fibers/mm$^2$).

The exposing device 3C is of a known type using a semiconductor laser, and is adjusted to lower the potential of an image portion of the surface of the photosensitive drum 1C charged to −800 V to about −50 V with laser beam irradiation.

The developing device 4C is a mono-component developing device, and its structure and operation are the substantially same as those of the developing device 4A in the printer P1 shown in FIG. 1. The substantially same portions and parts bear the same reference numbers as those of the developing device 4A.

A power source (not shown) applies to the developing sleeve 43 a developing bias voltage of −250 V, by which the toner T can be adhered onto an electrostatic latent image on the photosensitive drum 1C.

The photosensitive drum 1C and the toner T used therein are the same as the photosensitive drum 1B and the toner T used in the printer P2 shown in FIG. 7.

The developing sleeve 43 is manufactured as follows.

A round rod of 25 mm in diameter made of stainless steel is dipped into nickel electrolyte, and a film of about 35 μm in thickness is formed by electroforming. A nip width of about from 1 to 1.5 mm is achieved between the sleeve 43 and the photosensitive drum 1C in the developing operation.

The restriction blade 45 can adhere the toner T onto the developing sleeve 43 with an adhesion rate of 0.6 mg/cm$^2$, a toner layer thickness of about 0.03 mm and a charging quantity of −20 μC/g.

According to the printer P4 described above, the surface of the photosensitive drum 1C which is driven to rotate is charged uniformly to −800 V by the brush charging device 2C. The exposing device 3C effects the image exposure on the charged region to form the electrostatic latent image. The potential of the exposed surface portion is lowered to about −50 V. The electrostatic latent image thus formed is developed by the developing device 4C with a developing bias voltage of −250 V into a toner image. In this developing, the toner T on the developing sleeve 43 adheres onto the electrostatic latent image with a potential difference ΔV of 200 V.

The transfer charger 5C transfers the toner image thus formed onto the sheet of paper 7 supplied from a transfer sheet supply device (not shown). After the transfer, the sheet 7 is separated from the photosensitive drum 1C by the separating charger 6C, moves to a fixing device (not shown) to fix the toner image, and then is discharged.

However, the toner on the photosensitive drum 1C is not entirely transferred onto the sheet 7 by the transfer charger 5C, but 10–20% of the toner generally remains as the residual toner on the photosensitive drum 1C. The residual toner returns to the developing device 4C through the charging stage performed by the charging device 2C and, if necessary, the stage for image exposure by the exposing device 3C, and the residual toner on the non-image portion is collected into the developing sleeve 43.

The residual toner T on the non-image portion of the drum 1C is forced to move toward the developing sleeve 43 by a potential difference of about 550 V, and simultaneously the developing sleeve 43 applies a scraping effect on the residual toner, so that the residual toner at the non-image portion is collected and removed toward the developing sleeve 43.

Prior to the above, the residual toner remaining on the photosensitive drum 1C is stirred and scattered by the rotary brush 21C in the charging device 2C, so that it will not remain as an after-image on the photosensitive drum 1C.

Assuming that m (fibers/mm$^2$) represents the number of brush fibers of the rotary brush 21C which are brought into contact with a unit area of the photosensitive drum surface during passing thereof through the contact nip with respect to the photosensitive member 1C, the condition of 350<m<4000 is satisfied. Therefore, it is possible to suppress reduction of durability of the photosensitive drum 1C by preventing shaving of the surface of the photosensitive drum 1C, and suppress variation of the charged potential of the photosensitive drum due to environmental variation. Further, the apparatus can sufficiently suppress generation of a memory by sufficiently scattering the untransferred residual developer with the rotary brush 21C. Therefore, the image quality can be improved.

Experiments which were performed for determining the foregoing condition of 350<m<4000 will be described below.

The image forming apparatus used in the experiments was the printer P4 shown in FIG. 23. The experiments were performed with various values of the outer diameter b (mm) of the charging rotary brush 21C of the charging device 2C, the outer diameter c (mm) of the roller 22C including the base cloth, the contact nip width w (mm) of the rotary brush 21C and the photosensitive drum 1C in the surface moving direction of the photosensitive drum 1C, the peripheral velocity ratio θ (a ratio of the peripheral velocity Vb of the rotary brush 21C to the peripheral velocity Vpc of the photosensitive drum 1C, θ=Vb/Vpc), and the average brush fiber density M (fibers/mm$^2$) on the base cloth of the brush 21C, which were shown in the following tables 1 and 2. In these experiments, evaluation was carried out with respect to (1) state of the image memory by the untransferred residual toner, (2) the state of the surface potential Vo of the photosensitive drum 1C due to environmental variation, and (3) the state of shaving of the surface film of the photosensitive drum 1C.

The evaluation method is as follows:

Method of Evaluating the Image Memory

A solid black image was used. Density of the image corresponding to a portion of first rotation of the photosensitive drum and density of the image corresponding to a portion of second rotation thereof were measured, and the density difference (ΔD) was evaluated in accordance with the following ranks for evaluating the image memory. The image densities were measured with a Sakura densitometer (model PDA-65) manufactured by Konica Co., Ltd.

| Image Density Difference | Evaluation mark |
|---|---|
| ΔD ≦ 0.1 | ○ |
| 0.1 < ΔD < 0.15 | Δ |
| 0.15 ≦ ΔD | X |

The evaluation mark "O" represents the preferable state that the image memory can be substantially ignorable, the evaluation mark "Δ" represents the state that the image memory is noticeable to a certain extent but is practically acceptable, and the evaluation mark "X" represents the state that the image memory is the practically unacceptable.

Methods of Measuring the Surface Potential of the Photosensitive Drum and Evaluating Variation of the Potential due to Environmental Change In each of a high temperature and high humidity environment (30° C., 85%) and a low temperature and low humidity environment (10° C., 15%), the surface potential (charged potential) (Vo) of the photosensitive drum 1C was measured with a probe of a surface electrometer (model 360 manufactured by Treck Co., Ltd.) set at the developing device 4C, and the differences (ΔVo) of the potentials (Vo) under these environmental conditions were ranked as follows for evaluating the environmental variation of the surface potential. The measurement was performed after leaving the test printer in these environments for 12 hours or more.

| Surface Potential Variation Width | Evaluation Mark |
|---|---|
| ΔVo ≦ 100V | ○ |
| 100V < ΔVo < 300V | Δ |
| 300V ≦ ΔVo | X |

The evaluation mark "O" represents the preferable state, the evaluation mark "Δ" represents the state that potential variation is noticeable to a certain extent but is acceptable, and the evaluation mark "X" represents the state that the potential difference is remarkable and the image density variation is not practically acceptable.

Methods of Measuring and Evaluating Shaving of the Surface Film of the Photosensitive Drum 1C After printing of 5000 sheets, an amount of reduction of the film thickness of the photosensitive layer was measured, and was ranked as follows for evaluating them. Measurement of the film thickness was performed with an eddy-current instrument for measuring thickness (model EC8e2Ty manufactured by HELMUT FISCHER Co. in Germany).

| Reduced Thickness | Evaluation Mark |
|---|---|
| Δf ≦ 1 μm | ○ |
| 1 μm < Δf < 3 μm | Δ |
| 3 μm ≦ Δf | X |

The evaluation mark "O" represents the preferable state, the evaluation mark "Δ" represents the state that reduction is noticeable to a certain extent but is acceptable, and the evaluation mark "X" represents the state that the durability of the photosensitive drum 1C is unacceptably low.

Results of the evaluation are shown in the tables 1 and 2.

TABLE 1

| | | Experimental Example | | | | | | | | | | | | |
|---|---|---|---|---|---|---|---|---|---|---|---|---|---|---|
| | | c1 | c2 | c3 | c4 | c5 | c6 | c7 | c8 | c9 | c10 | c11 | c12 | c13 |
| Brush Setting | b[mm] | 16 | 16 | 16 | 16 | 16 | 16 | 16 | 16 | 18 | 18 | 18 | 20 | 14 |
| Condition | c[mm] | 9 | 9 | 9 | 9 | 9 | 9 | 7 | 7 | 9 | 7 | 5 | 7 | 7 |
| | w[mm] | 8 | 8 | 8 | 8 | 8 | 8 | 6 | 14 | 10 | 10 | 10 | 5 | 5 |
| | θ | 4 | 4 | 4 | 1.7 | −2 | 6.5 | −1 | −1 | 6 | 6 | 6 | 2.5 | 2.5 |
| | M(fibers/mm$^2$) | 155 | 93 | 31 | 155 | 155 | 155 | 155 | 155 | 155 | 155 | 155 | 155 | 155 |
| m value | | 2093 | 1256 | 419 | 488 | 1395 | 3836 | 407 | 949 | 3875 | 3014 | 2153 | 407 | 581 |
| Evaluation | Image Memory | ○ | ○ | Δ | ○ | ○ | ○ | Δ | ○ | ○ | ○ | ○ | Δ | ○ |

TABLE 1-continued

| | | Experimental Example | | | | | | | | | | | | |
|---|---|---|---|---|---|---|---|---|---|---|---|---|---|---|
| | | c1 | c2 | c3 | c4 | c5 | c6 | c7 | c8 | c9 | c10 | c11 | c12 | c13 |
| Results | Vo Env. Variation | ○ | ○ | ○ | ○ | ○ | ○ | ○ | ○ | ○ | ○ | ○ | ○ | ○ |
| | P. Drum Shaving | ○ | ○ | ○ | ○ | ○ | ○ | ○ | ○ | ○ | ○ | ○ | ○ | ○ |
| | Total Evaluation | ○ | ○ | ○ | ○ | ○ | ○ | ○ | ○ | ○ | ○ | ○ | ○ | ○ |

Vo Env. Variation: Vo Environmental Variation
P. Drum Shaving: Photosensitive Drum Shaving

TABLE 2

| | | Example for Comparison | | | | | | | | |
|---|---|---|---|---|---|---|---|---|---|---|
| | | c1 | c2 | c3 | c4 | c5 | c6 | c7 | c8 | c9 |
| Brush Setting Condition | b[mm] | 16 | 16 | 16 | 16 | 16 | 18 | 24 | 24 | 20 |
| | c[mm] | 9 | 9 | 9 | 9 | 7 | 12 | 7 | 16 | 8 |
| | w[mm] | 8 | 8 | 8 | 8 | 4 | 10 | 5 | 10 | 5 |
| | θ | 4 | 1.4 | −6 | 9 | 1 | 6 | 2.5 | −2 | 2 |
| | M(fibers/mm$^2$) | 23 | 155 | 155 | 155 | 155 | 155 | 155 | 310 | 155 |
| m value | | 311 | 279 | 4185 | 5580 | 271 | 5167 | 339 | 4133 | 310 |
| Evaluation Results | Image Memory | X | X | ○ | ○ | X | ○ | X | ○ | X |
| | Vo Env. Variation | ○ | ○ | X | X | ○ | X | ○ | X | ○ |
| | P. Drum Shaving | ○ | ○ | X | X | ○ | X | ○ | X | ○ |
| | Total Evaluation | X | X | X | X | X | X | X | X | X |

Vo Env. Variation: Vo Environmental Variation
P. Drum Shaving: Photosensitive Drum Shaving The experimental examples c1, c2 and c3 as well as the example for comparison c1 were performed with the brush fiber density M of different values, respectively.

The experimental examples c4, c5 and c6 as well as the examples for comparison c2, c3 and c4 for comparison were performed with the peripheral velocity ratio θ of different values, respectively.

The experimental examples c7 and c8 as well as the example c5 for comparison were performed with the nip width w of different values, respectively.

The experimental examples c9, c10 and c11 as well as the example c6 for comparison were performed with the rotary brush roller diameter c of different values, respectively.

The experimental examples c12 and c13 as well as the example c7 for comparison were performed with the rotary brush diameter b of different values, respectively.

The example c8 for comparison represents an example of m of a large value due to large M and c, and the example c9 for comparison represents an example of m of a small value.

From the above results of experiments, m in a range from about 350 to about 4000 can achieve practically acceptable images.

If the value of m is lower than 350, a problem arises in connection with the image memory, because the residual developer cannot be scattered sufficiently, although no practical problem arises in connection with environmental variation of Vo and shaving of the photosensitive member film. If the value of m is larger than 4000, a practical problem arises in connection with environmental variation of Vo and shaving of the photosensitive member film, although no problem arises in connection with the image memory. Accordingly, it can be found that appropriate m is in a range from 350 to 4000.

In the above printer P4, the voltage applied to the rotary brush 21C is formed of the DC voltage and the AC voltage superimposed thereon, but it may be formed of only the DC voltage.

(Fifth Embodiment)

A fifth embodiment of the invention will now be described below.

An image forming apparatus of the fifth embodiment is also of a simultaneous developing/cleaning type. It employs, as the charging device for charging the surface of the photosensitive member, a contact charging device having a charging rotary brush. The rotary brush includes a fiber-set cloth, which is provided with electrically conductive brush fibers fixed to a base cloth, and is wound around a core rod or roller.

Assuming that N is the number of brush fibers which project from one of meshes defined by warps and wefts of the fiber-set cloth, and D (μm) is a diameter or thickness of each brush fiber, these parameters satisfy the following condition:

$$1000<N\cdot D<10000$$

The image forming apparatus of the above type can uniformly and effectively scatter the untransferred residual toner, which remains on the photosensitive member after transfer of the toner image on the photosensitive member onto the transfer member or sheet, without reduction of durability of the photosensitive member, and can uniformly charge the photosensitive member.

The untransferred residual developer is relatively strongly adhered onto the surface of the photosensitive member by electrical and physical forces. Therefore, only the employment of the charging rotary brush cannot sufficiently suppress generation of a memory caused by so-called exposure shading. In order to scatter the residual developer, it is necessary to employ an appropriate manner and/or structure for applying a force larger than the adhesion force to developer particles, so that the residual developer can be uniformly and sufficiently dispersed.

According to dynamical calculation, a mechanical force of brush fibers acting on toner particles can be increased by increasing a modulus of elasticity (Young's modulus) and a diameter of the brush fiber and reducing a length of the fiber. Thus, the mechanical force can be increased by increasing an elastic strength of the brush fiber.

The elastic strength of the brush fiber may be increased by selecting a material having a large modulus of elasticity and selecting a thick and short fiber. However, the thick and short fibers cannot uniformly disperse the residual developer, because it is difficult to achieve uniform and stable contact of the brush with the photosensitive member. Further, a problem arises in connection with one of the functions of the brush, i.e., charging, and more specifically, the charging uniformity is impaired.

In view of the above, the embodiment employs the bundles each including an appropriate number of the brush fibers having an appropriate thickness, and an appropriate relationship is set between the diameter D of the brush fiber and the number N of the brush fibers projecting from each of meshes defined by the warps and wefts of the base cloth. Thereby, the brush fibers have an appropriately large elastic strength as a whole for suppressing shaving of the photosensitive member, which reduces the durability of the photosensitive member, and sufficiently scattering the untransferred residual developer.

If the number N of fibers were excessively small, the untransferred residual toner would not be scattered sufficiently, and the charging would not be performed uniformly. If it were excessively large, a problem relating to grouping of the fibers would arise.

Accordingly, the number N is preferably in a range from 60 to 600.

If the fiber diameter D were excessively small, the fiber strength and the scattering effect would not be obtained. If it were excessively large, the uniform scattering and uniform charging would be difficult.

Accordingly, the value D is preferably in a range from 5 to 100 (μm).

With respect to the value of N·D, a larger value exceeding about 1000 is preferable in view of the effect of scattering the untransferred residual toner. However, if it were excessively large, problems would arise in connection with shaving of the photosensitive member surface and the durability of the photosensitive member. Accordingly, the value up to about 10000 is preferable.

In a conventional image forming apparatus which is provided with a dedicated cleaning device and uses the rotary brush of the charging device only for charging, it has been found that N·D value larger than 10000 does not cause a practically disadvantageous shaving of the photosensitive member. In the image forming apparatus of the simultaneous developing/cleaning type, the reason of the fact that the upper limit of N·D must be about 10000, i.e., smaller than that in the conventional apparatus has not been specifically clarified, but this is probably due to the fact that the rotary brush frictionally slides on the photosensitive member surface covered with the untransferred residual toner layer, and thus the developer particles act as a kind of abrasive to promote shaving of the photosensitive member.

Here, the charging rotary brush and others in the charging device will be described below more in detail.

With respect to the structure of the fiber-set cloth

The fiber-set cloth forming the charging rotary brush may selectively employ various structures, and typically may have a structure which is substantially the same as a so-called velvet in view of strength, productivity, fiber density and others. For example, as already discussed with reference to FIG. 9(A), the fiber-set cloth BM1 has the structure in which the piles P formed of brush fibers are woven into many spaced positions of the base member, i.e., base cloth B1.

In the case where the fiber-set cloth BM1 of the type shown in FIG. 9(A) is employed, the manner of weaving of the piles P into the base cloth B1 may be typically a so-called V-shaped weaving shown in FIGS. 10(A) and 10(B), in which each pile P is woven into yarns S forming the base cloth B1 in a V-shaped form. Alternatively, it may be a so-called W-shaped weaving shown in FIGS. 11(A) and 11(B), in which each pile P is woven into yarns S forming the base cloth B1 in a W-shaped form. The W-shaped weaving can prevent disengage or drop of brush fibers more effectively than the V-shaped weaving.

As a special weaving manner, the manner shown in FIG. 12(A) may be employed in which each pile P is passed through the base cloth B1, and a flat knot is formed at the rear side of the base cloth.

As modifications (employing different pile pitches) of the V-shaped weaving and W-shaped weaving shown in FIGS. 10(A) and 11(A), weaving manners shown in FIGS. 12(B)–12(F) may be employed. These manners are already described. In any of these manners, the brush fibers project from the meshes CL (will be called as a "cell" hereafter) defined by the warps and wefts of the base cloth B1.

The average fiber density in the whole fiber-set cloth may be in a range from 30 to 400 (fibers/$mm^2$).

The structure of the fiber-set cloth may be other than those already described.

In any case, the number N of the brush fibers projecting from each cell CL or mesh of the base cloth is in a range from 60 to 600, and satisfies the relationship of $1000<N\cdot D<10000$.

With respect to the material of the brush fibers

The material of the brush fibers may be selected similarly to the brush fiber material already discussed in connection with the second and third embodiments, and can be selected from various materials having appropriate electric resistance, flexibility, hardness, configuration and strength for achieving an intended charge quantity and intended effect for scattering the untransferred residual toner.

The electrically conductive metal brush fibers may be employed, and the electrically conductive resin brush fibers may be employed. In these cases, the material may be selected similarly to that of the brush fibers already discussed in connection with the second and third embodiments.

The brush fiber may have a cross section allowing easy manufacturing such as a circular shape, elliptic shape, wavy circular shape, polygonal shape, flat shape or a hollow shape, provided that the intended force for scattering the residual toner and the charging properties can be maintained.

The shape of the tip of the brush fiber is not particularly restricted, and may be substantially circular or may be obliquely cut in view of alignment with respect to the photosensitive member, developer and others, molding of the brush fibers, cutting of the brush fibers, and other processing. Also, it may be spherical, and the brush fibers themselves may have a form woven into a loop as a whole.

In view of similar factors, all the brush fibers in the rotary brush may not have similar properties, and multiple kinds of brush fibers having different configurations, resistances, bending properties, material properties or the like may be regularly or irregularly arranged. In view of similar factors, each brush fiber is not restricted with respect to its construction, and may have a particular resistance distribution, and a plurality of material may be used in a mixed or layered form.

The diameter (thickness) D of the brush fiber is not particularly restricted provided that a close contact can be ensured with respect to the photosensitive member and the strength of the brush fiber causes no problem in connection with the practical handling and durability. As already described, it may be in a range from 5 to 100 μm. Since the scattering force must be applied efficiently to the residual toner, the brush fiber material must have an appropriate flexible strength, and the modulus of elasticity (Young's modulus) is preferably in a range from 300 to 3000 $kgmm^{-2}$.

In the wet spinning, which is generally used for forming fibers, and extrusion, which is one kind of film formation, layers of different properties can be easily layered by multiple or multi-layered spinning nozzles. Therefore, the invention can employ this technique as a method of processing the surface coating in the brush fiber manufacturing process. In this case, the film thickness of the surface coating layer is not particularly restricted provided that the adhesivity with respect to the brush fiber body material is not impaired and an intended resistance can be achieved in the surface coating layer, and the film thickness may be generally in a range from 1 to 50 μm. For the purpose of ensuring adhesivity in the process of providing the surface coating layer on the brush fiber body material, silane coupling agent or primer layer may be applied to the brush fiber body material, or treatment with acid, alkali or plasma may be performed before providing the surface coating layer.

In any case, the diameter (thickness) D of the brush fiber is in a range from about 5 to about 100 μm and is set to satisfy the condition of $100<N\cdot D<10000$, as already described.

With respect to support and rotation of the fiber-set cloth

The fiber-set cloth is arranged around the roller to form the rotary brush. In many cases, electrical conductivity is generally given to the roller for applying the charging voltage through the roller. The electrically conductive roller may be made of steel, stainless steel, aluminum, copper, chrome, titanium or the like, or may be made of a resin material, a fiber material or the like treated to have an electrically conductive.

The fiber-set cloth may be fixed to the roller in such a manner that the fiber-set cloth BM1 is spirally wound around the roller R1 having a circular section as shown in FIG. 13(A), or straightly wound around the roller R1 as shown in FIG. 13(B), and fixed with electrically conductive adhere to the roller. Also, it may be shaped cylindrically, and then may be fitted and fixed onto the roller R1 with electrically conductive adhesive as shown in FIG. 13(C). Further, as shown in FIG. 13(D), the following structure may be employed. The electrically conductive plate member R2 is rounded into a cylindrical form, and the fiber-set cloth is wound around the cylindrical member R2. The ends of the cloth are fixedly pinched between the mating edges of the plate member. The assembly thus formed is driven to rotate. In this case, electrically conductive adhesive may be used. Further, a structure shown in FIG. 13(E) may be employed, in which the fiber-set cloth has an endless-strip-like form, and is retained around the pulleys R3 and R4, at least one of which is driven to rotate, and at least one of which has electrically conductivity.

The rotary brush thus formed is brought into contact with the surface of the photosensitive drum.

The rotary brush is charged with, e.g., a DC voltage, or a voltage formed of a DV ingredient and an AC ingredient superimposed thereon for preventing, e.g., variation of the charged potential due to environmental variation. This DC voltage is substantially in a range from 800 to 1500 V, and the superimposition of the AC ingredient is performed with a peak-to-peak from 400 to 2000 V and a frequency from 50 Hz to 2 kHz. In this case, the AC ingredient may have a sinusoidal waveform, or instead of it, for example, may employ a pulse-form such as a square wave form prepared by switching predetermined two voltage values with a predetermined duty ratio in order to reduce a cost of electric power.

With respect to the photosensitive member

The photosensitive member may be selected from various kinds of photosensitive members already discussed in connection with the second and third embodiments.

Figure 25:
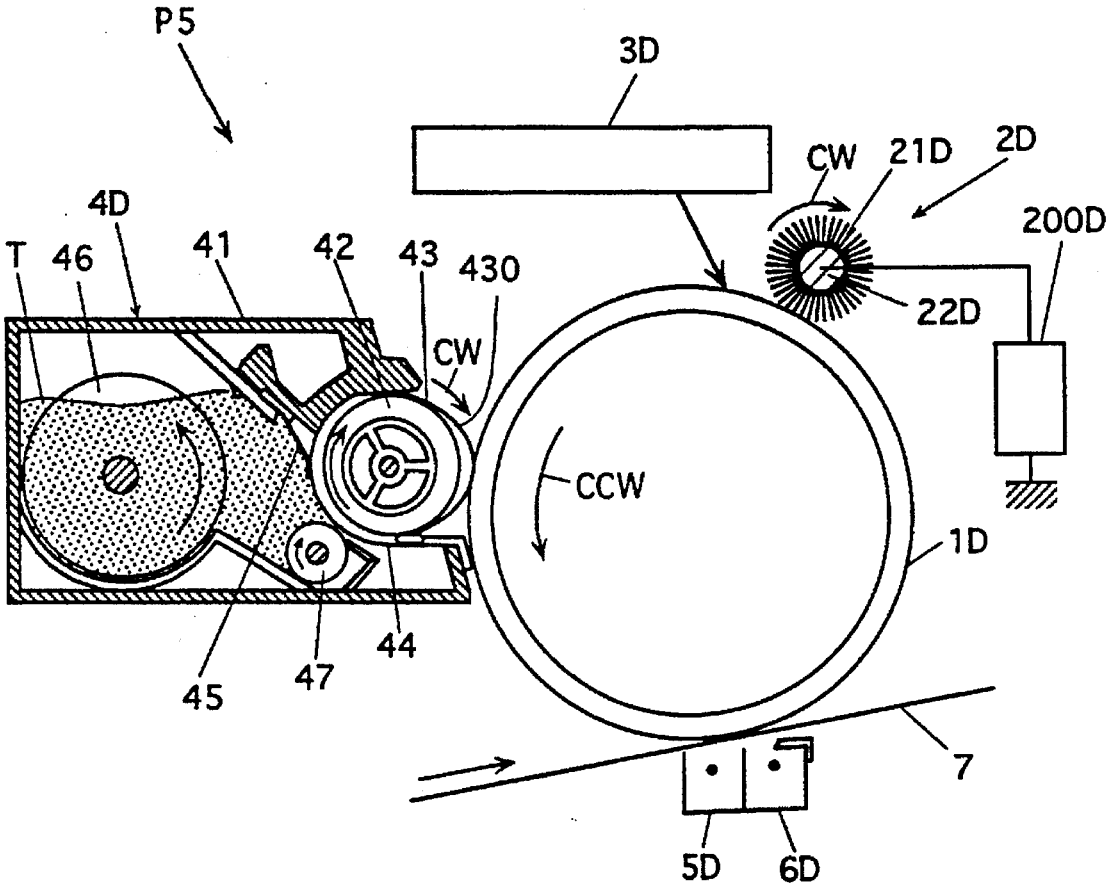
FIG. 25 shows a schematic structure of further another example of a major portion of a printer according to the invention.

FIG. 25 schematically shows a structure of a major portion of a laser beam printer P5 provided with the charging device according to the invention. This printer P5 is prepared by remodeling the printer SP-101 manufactured by Minolta Co., Ltd.

The printer P5 is provided at its central portion with a photosensitive drum 1D. The drum 1D is driven to rotate in a direction CCW indicated by an arrow in the figure (counterclockwise direction) by an unillustrated driving device. Around the drum 1D, there are sequentially disposed a contact charging device 2D, an exposing device 3D, a developing device 4D, a transfer charger 5D, and a separating charger 6D.

The contact charging device 2D includes a charging rotary brush 21D. The rotary brush 21D has a structure similar to that shown in FIG. 13(A), in which many piles P formed of electrically conductive brush fibers are fixed to the base cloth B1 (see FIG. 9(A)), and the fiber-set cloth BM1 thus formed is spirally wound and adhered around an electrically conductive roller 22D (see FIG. 25) having a circular section with electrically conductive adhesive to form a roller-like configuration.

The rotary brush 21D is in contact with the photosensitive drum 1D and is driven to rotate clockwise in the figure, and a power source 200D applied a DC voltage of −1.3 kV to the rotary brush 21D for charging the surface of the photosensitive drum 1D to −800 V.

The exposing device 3D is of a known type using a semiconductor laser, and is adjusted to lower the potential of an image portion of the surface of the photosensitive drum 1D charged to −800 V to about −50 V with laser beam irradiation.

The developing device 4D is a mono-component developing device, and its structure and operation are the substantially same as those of the developing device 4A in the printer P1 shown in FIG. 1. The substantially same portions and parts bear the same reference numbers as those of the developing device 4A.

The specifications of the above photosensitive member 1D and the used toner T are the same as the photosensitive member 1B and the toner T used in the printer P2 shown in FIG. 7, respectively.

The developing sleeve 43 and the restriction blade 45 are the same as those in the developing device 4C of the printer P4 shown in FIG. 23.

The rotary brush 21D may be selected from various structures, and will be described below.

Rotary Brush Core Roller 22D

The core roller 22D may have a diameter in a range from 6 to 8 mm, and 6 mm is selected in this embodiment. Its length is 300 mm, and it is formed of a metal shaft made of stainless steel (SUS303).

Brush Fibers

Fibers mainly containing rayon and fibers mainly containing polyamide are prepared, and the rotary brushes 21D are manufactured from these fibers.

These brush fibers are manufactured by the wet spinning, which is a general method for fiber production, with the spinning nozzle diameter adjusted appropriately. An appropriate amount of electrically conductive agent mainly containing electrically conductive carbon is added to the fiber material in the process of loading the material before the spinning, so that the spun rayon-contained fibers may have an electric resistance from $10^5$ to $10^7$ Ωcm, and the spun polyamide-contained fibers may have an electric resistance from $10^6$ to $10^8$ Ωcm. The required electric resistance after the spinning is generally in a range from $10^1$ Ωcm to $10^9$ Ωcm.

The rayon-contained fibers have minute wrinkles at its surface, which is a distinctive feature of its form caused by the manufacturing reason. The polyamide-contained fibers have a smooth surface and thus a columnar shape, which is a distinctive feature of its form caused by the manufacturing reason.

Regardless of the kind of the fibers, the brush fibers are formed to have a circular section at its tip portion.

Regardless of the kind of the fibers, the diameter (thickness) D of the brush fiber is determined as indicated in connection with the experimental examples 1–9 to be described later.

Base Cloth B1

The base cloth is made of polyester fibers.

Fiber-Set Cloth BM1

The pile P is made of the brush fibers depending on the fiber strength. In the case of the rayon-contained fibers, 72–200 fibers are bundled to form the pile P. Also in the case of the polyamide-contained fibers, 72–200 fibers are bundled to form the pile P. The piles thus formed are woven into the polyester base cloth B1 in a W-like form to produce a velvet-like cloth, and electrically conductive liquid is impregnated into the base cloth thus formed to form a strip-like configuration.

The strip-like fiber-set cloth BM1 may have a width selected from a range from about 10 to about 50 mm. The base cloth B1 may have a finished thickness selected from a range from about 0.5 to about 2 mm. The pile may have a height selected from a range from about 5 to about 30 mm. Regardless of the kinds of the fibers, here, the strip-like fiber-set cloth BM1 has the width of about 20 mm, the base cloth B1 has the finished thickness of about 1 mm, and the pile P has the height of about 6 mm.

The average fiber density may be in a range from $2\times10^4$ to $2\times10^5$ fibers/square inch (30–300 fibers/$mm^2$), and the numbers shown in the experiments 1–9 to be described later are selected as the number N of brush fibers projecting from one cell of the base cloth so as to satisfy the condition of $1000<N\cdot D<10000$.

Regardless of the kinds of the brush fibers, the values of D·N shown in the experiments 1–9 to be described later are selected. The value of D·N depends on combination of the brush fiber diameter D(μm) and the number N of the brush fibers projecting from one cell of the base cloth B1.

Fixing of the strip-like Fiber-Set Cloth to the Roller 22D

The strip-like fiber-set cloth BM1 is spirally wound around and adhered to the roller 22D with electrically conductive adhesive, and surplus ends of the fiber-set cloth are cut off after hardening of the adhesive.

Conditions of Setting of the Rotary Brush 21D to the Photosensitive Drum 1D

Figure 26:
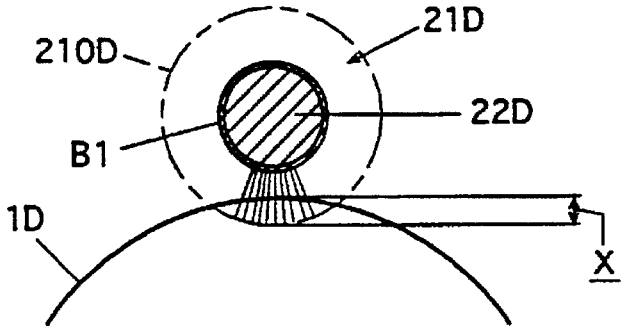
FIG. 26 shows a set state of a charging rotary brush with respect to a photosensitive drum.

As shown in FIG. 26, an outer peripheral line 210D, which is indicated by alternate long and short dash line and is defined by tips of the brush fibers of the rotary brush 21D, is set to intersect an outer peripheral line of the photosensitive drum 1D. The brush pressed-in length X may be selected from a range from 0.5 mm to 5 mm, and is set to 2 mm in this example.

According to the printer P5 described above, the surface of the photosensitive drum 1D which is driven to rotate is charged uniformly to −800 V by the contact charging device 2D. The exposing device 3D effects the image exposure on the charged region to form the electrostatic latent image. The potential of the exposed surface portion is lowered to about −50 V. The electrostatic latent image thus formed is developed by the developing device 4D with a developing bias voltage of −250 V into a toner image. In this developing, the toner T on the developing sleeve 43 adheres onto the electrostatic latent image with a potential difference ΔV of 200 V.

The transfer charger 5D transfers the toner image thus formed onto the sheet of paper 7 supplied from a transfer sheet supply device (not shown). After the transfer, the sheet 7 is separated from the photosensitive drum 1D by the separating charger 6D, moves to a fixing device (not shown) to fix the toner image, and then is discharged.

However, the toner on the photosensitive drum 1D is not entirely transferred onto the sheet 7 by the transfer charger 5D, but 10–20% of the toner generally remains as the residual toner on the photosensitive drum 1D. The residual toner returns to the developing device 4D through the charging stage performed by the charging device 2D and, if necessary, the stage for image exposure by the exposing device 3D, and the residual toner on the non-image portion is collected into the developing sleeve 43. Thus, the residual toner T on the non-image portion of the drum 1D is forced to move toward the developing sleeve 43 by a potential difference of about 550 V, and simultaneously the developing sleeve 43 applies a scraping effect on the residual toner, so that the residual toner at the non-image portion is collected and removed toward the developing sleeve 43.

Prior to the above, the residual toner remaining on the photosensitive drum 1D is stirred and scattered into an unpatterned form by the rotary brush 21D in the charging device 2D, so that it will not remain as an after-image on the photosensitive drum 1D.

The N of the brush fibers projecting from the cell of the fiber-set cloth forming the rotary brush 21D and the diameter D (μm) of one brush fiber are set to satisfy the following relationship:

$$1000<N\cdot D<10000$$

Therefore, it is possible to suppress shaving of the surface of the photosensitive drum 1D and thus reduction of the durability of the photosensitive drum 1D, and also it is possible to scatter sufficiently the untransferred residual toner by the rotary brush 21D and thus to prevent sufficiently the generation of a memory, so that the image quality can be improved.

Description will now be given on the experiments which were performed for determining the above condition of $1000<N\cdot D<10000$.

The experiments were performed with the printer shown in FIG. 25. In the rotary brush 21D of the charging device 2D, the diameter D (μm) of the brush fiber and the number N of the brush fibers projecting from one cell of the base cloth B1 were varied as shown in experimental examples d1–d9 and examples for comparison d1–d5 in the lists to be described later. Other brush conditions were the same as those already described. The experimental examples d1–d9 and the examples for comparison d1–d5 were performed with the brush fibers formed of rayon-contained fibers. However, similar results were obtained with the rotary brush 21D using polyamide-contained fibers.

In the experiments, solid black images were continuously printed after printing of 1000 sheets, and the densities of the images of the portions corresponding to the first and second rotations of the photosensitive drum after printing of 1000 sheets were measured to determined the density difference, from which the image memory was evaluated. The density difference (ΔD) was evaluated in accordance with the following ranks. The image densities were measured with a Sakura densitometer (model PDA-65) manufactured by Konica Co., Ltd.

| Image Density Difference | Evaluation mark |
|---|---|
| $\Delta D \leqq 0.1$ | ○ |
| $0.1 < \Delta D < 0.15$ | Δ |
| $0.15 \leqq \Delta D$ | X |

The evaluation mark "O" represents the preferable state that the image memory can be substantially ignorable, the evaluation mark "Δ" represents the state that the image memory is noticeable to a certain extent but is practically acceptable, and the evaluation mark "X" represents the practically unacceptable.

Also, the experiments were performed for evaluating shaving of the surface film of the photosensitive drum 1D. After printing of 10000 sheets, an amount of reduction (Δf) of the film thickness of the photosensitive layer of the photosensitive drum 1D was measured, and was ranked as follows. Measurement of the film thickness was performed with an eddy-current instrument for measuring thickness (model EC8e2Ty manufactured by HELMUT FISCHER Co. in Germany).

| Reduced Thickness | Evaluation Mark |
|---|---|
| $\Delta f \leqq 2$ μm | ○ |
| 2 μm < Δf < 5 μm | Δ |
| 5 μm ≦ Δf | X |

The evaluation mark "O" represents the preferable state, the evaluation mark "Δ" represents the state that reduction is noticeable to a certain extent but is acceptable, and the evaluation mark "X" represents the state that the durability of the photosensitive drum 1D is unacceptably reduced.

Result of the evaluation are shown in the following list.

EXPERIMENTAL EXAMPLES

| | d1 | d2 | d3 | d4 | d5 | d6 | d7 | d8 | d9 |
|---|---|---|---|---|---|---|---|---|---|
| Brush Setting Conditions | | | | | | | | | |
| N (fibers) | 100 | 100 | 200 | 200 | 200 | 400 | 72 | 80 | 144 |
| D (μm) | 10 | 20 | 20 | 40 | 20 | 20 | 20 | 20 | 20 |
| N · D | 1000 | 2000 | 4000 | 8000 | 4000 | 8000 | 1440 | 1600 | 2880 |
| Evaluation Results | | | | | | | | | |
| Image Memory | Δ | ○ | ○ | ○ | ○ | ○ | ○ | ○ | ○ |
| Shaving | ○ | ○ | ○ | ○ | ○ | ○ | ○ | ○ | ○ |
| Total Evaluation | ○ | ○ | ○ | ○ | ○ | ○ | ○ | ○ | ○ |

EXAMPLES FOR COMPARISON

| | d1 | d2 | d3 | d4 | d5 |
|---|---|---|---|---|---|
| Brush Setting Conditions | | | | | |
| N (fibers) | 100 | 200 | 400 | 40 | 72 |
| D (μm) | 8 | 70 | 40 | 20 | 10 |
| N · D | 800 | 14000 | 16000 | 800 | 720 |
| Evaluation Results | | | | | |
| Image Memory | X | ○ | ○ | X | X |
| Shaving | ○ | X | X | ○ | ○ |
| Total Evaluation | X | X | X | X | X |

From the above results of experiments, the N·D values in a range from about 1000 to about 10000 can sufficiently suppress reduction of the durability of the photosensitive member, which may be caused by shaving of the surface of the photosensitive drum 1D, and can sufficiently suppress generation of a memory by sufficiently scattering the untransferred residual developer with the charging rotary brush 21D, so that the image quality can be improved. Of course, the photosensitive drum 1D can be charged uniformly.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A charging device for electrically charging a surface of a member to be charged, comprising:

a roller which is rotatably provided; and a strip-like fiber member which is spirally wound around said roller, said strip-like fiber member having a plurality of piles, said piles being in contact with said surface of said member to be charged, wherein said charging device satisfies the following formula:

$$0.7s<d<1.5s$$

where d(mm) is a wound margin of said strip-like fiber member, and s(mm) is an average distance between said piles in a width direction of said strip-like fiber member.

2. A charging device as claimed in claim 1, wherein said surface of said member to be charged and said piles move in the same direction at a contact area where the piles are in contact with said surface, and a velocity of said piles is one through four times as large as a velocity of said surface at the contact area.

3. An image forming apparatus provided with said charging device as claimed in claim 1, comprising a developing device for simultaneously performing developing and cleaning of untransferred residual developer.

4. An image forming apparatus as claimed in claim 3, wherein said surface of said member to be charged and said piles move in the same direction at a contact area where the piles are in contact with said surface, and a velocity of said piles is one through four times as large as a velocity of said surface at the contact area.

5. A charging device as claimed in claim 1, wherein each of said piles has a plurality of fibers.

6. A charging device for electrically charging a surface of a member to be charged, comprising:

a fiber member having a plurality of piles, said piles being in contact with said surface of said member to be charged, wherein said charging device satisfies the following formula:

$$0.44 \leqq Lmin/Lmax \leqq 1$$

where Lmax and Lmin are the maximum value and minimum value of distances from one of the piles to the other piles adjacent thereto, respectively.

7. A charging device as claimed in claim 3, wherein said charging device further satisfies the following formula:

$$0.6 \leqq Lmin/Lmax \leqq 1.$$

8. An image forming apparatus provided with said charging device as claimed in claim 6, comprising a developing device for simultaneously performing developing and cleaning of untransferred residual developer.

9. An image forming apparatus as claimed in claim 8, wherein said charging device further satisfies the following formula:

$$0.6 \leqq Lmin/Lmax \leqq 1.$$

10. A charging device as claimed in claim 6, wherein each of said piles has a plurality of fibers.

11. A charging device for electrically charging a surface of a member to be charged, comprising:

a rotatable roller; and a fiber sheet provided on said roller, said fiber sheet having a plurality of piles each having a plurality of brush fibers, wherein said charging device satisfies the following formula:

$$1000 < N \cdot D < 10000$$

where D (μm) is a diameter of each of the brush fibers, and N is a number of the brush fibers of each of said piles.

12. A charging device as claimed in claim 11, wherein D is in a range from 5 μm to 100 μm.

13. A charging device as claimed in claim 11, wherein N is in a range from 60 to 600.

14. An image forming apparatus provided with said charging device as claimed in claim 11, comprising a developing device for simultaneously performing developing and cleaning of untransferred residual developer.

15. An image forming apparatus as claimed in claim 14, wherein D is in a range from 5 μm to 100 μm.

16. An image forming apparatus as claimed in claim 14, wherein N is in a range from 60 to 600.

17. A charging device as claimed in claim 11 wherein said charging device is provided in an image forming apparatus which includes a developing device for simultaneously performing developing and cleaning of untransferred residual developer from said surface of said member to be charged.

* * * * *

UNITED STATES PATENT AND TRADEMARK OFFICE

CERTIFICATE OF CORRECTION

PATENT NO. : 5,652,649

DATED : July 29, 1997

INVENTOR(S) : IKEGAWA et al

It is certified that error appears in the above-indentified patent and that said Letters Patent is hereby corrected as shown below:

Column 37, claim 7, line 23, delete "in claim 3" and insert --in claim 6--.

Signed and Sealed this

Fourteenth Day of July, 1998

Bruce Lehman

*Attest:*

BRUCE LEHMAN

*Attesting Officer*

*Commissioner of Patents and Trademarks*